US006464010B1

(12) United States Patent
Brown

(10) Patent No.: US 6,464,010 B1
(45) Date of Patent: Oct. 15, 2002

(54) APPARATUS AND METHOD FOR CLEANING A TUBULAR MEMBER WITH A BRUSH

(75) Inventor: Billy L. Brown, Houston, TX (US)

(73) Assignee: Global Completion Services, Inc., Houston, TX (US)

( * ) Notice: Subject to any disclaimer, the term of this patent is extended or adjusted under 35 U.S.C. 154(b) by 30 days.

(21) Appl. No.: 09/711,801

(22) Filed: Nov. 13, 2000

Related U.S. Application Data

(63) Continuation-in-part of application No. 09/361,066, filed on Jul. 26, 1999, now Pat. No. 6,209,647, and a continuation-in-part of application No. 09/133,913, filed on Aug. 13, 1998, now Pat. No. 5,947,203.

(51) Int. Cl.[7] ..... E21B 37/00
(52) U.S. Cl. ..... 166/311; 166/173; 15/104.2
(58) Field of Search ..... 166/311, 170, 166/172, 173, 174; 15/104.05, 104.095, 104.16, 104.2

(56) References Cited

U.S. PATENT DOCUMENTS

| | | | | |
|---|---|---|---|---|
| 2,682,069 | A | | 6/1954 | Scrimiger |
| 3,824,646 | A | | 7/1974 | Jai |
| 4,503,578 | A | | 3/1985 | McIntyre |
| 5,419,397 | A | | 5/1995 | Reynolds et al. |
| 5,447,200 | A | * | 9/1995 | Dedora et al. |
| 5,570,742 | A | | 11/1996 | Reynolds et al. |
| 5,711,046 | A | | 1/1998 | Potter |

* cited by examiner

*Primary Examiner*—Roger Schoeppel
(74) *Attorney, Agent, or Firm*—Domingue & Weddell, PLC

(57) ABSTRACT

A down hole cleaning assembly and method of cleaning a tubular. Generally, the down hole assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush member, operatively positioned within the groove of the pad member, for cleaning the internal diameter of the casing string. The pad member and groove may be helical, with the wire brush member positioned within the groove. The down hole assembly further comprises a biasing member, operatively positioned between the mandrel and the pad member, adapted for biasing the wire brush means against the inner diameter of the well bore.

21 Claims, 17 Drawing Sheets

APPARATUS AND METHOD FOR CLEANING A TUBULAR MEMBER WITH A BRUSH

This application is a continuation-in-part application of my application Ser. No. 09/361,066 filed on Jul. 26, 1999 now U.S. Pat. No. 6,209,647, as well as application Ser. No. 09/133,913 filed on Aug. 13, 1998 now U.S. Pat. No. 5,947,203.

BACKGROUND OF THE INVENTION

This invention relates to a down hole assembly used to clean tubular strings. More particularly, but not by way of limitation, this invention relates to an apparatus and method for cleaning the internal diameter of casing strings with a bristle brush circumferentially arranged about a down hole assembly.

In the development of oil and gas fields, operators will drill a well to a hydrocarbon reservoir, and thereafter, run a casing string through the production formation. The casing string will then be cemented into place. In turn, the well will then be completed as is well appreciated by those of ordinary skill in the art.

The optimization of production is an important criteria of any completion. Studies have shown that residue on the internal diameter of the casing string (such as cement, pipe dope, scale, burrs, et cetera) have a negative impact on productivity. Specialized completion fluids devoid of fines, solids and other debris are used to complete the well. Therefore, a major emphasis has been made to clean the inner diameter of the casing string.

Thus, when the operators have finished the pumping of a cement composition through the well casing, a work string is lowered on which a mechanical scraping device is used to scrap the walls of the casing. In the prior art, various types of casing scrapers are in use prior to displacement of a clean completion fluid. That is why it is so important to clean the casing wall as much as possible since it takes less time to ultimately filter the displaced completion fluids. Also, cleaning will eliminate foreign matter such as cement sheaths, scale, burrs and barite which in turn allows the tools used in the completion process to properly perform.

The scraping action of traditional scrapers with blades also have been known to leave a fine film of oil base or synthetic fluid residue on the casing wall. Prior art devices also cause problems because of the hardness of their blades cannot get into the casing connections as brushes can. Also, casing scrapers in high deviated holes collapse to the low side of the casing causing a great deal of wear on one side and the top side of the hole is not properly cleaning the high side due to ineffective engagement with the high side.

Therefore, there is a need for a down hole assembly that will be effective in cleaning a well bore that contains an oil base and/or synthetic fluid. There is also a need for a cleaning apparatus that will be effective in highly deviated wells. There is also a need for a down hole assembly that will have brush pads that are of sturdy construction and allow for ease of replacement.

SUMMARY OF THE INVENTION

A down hole cleaning assembly is disclosed. Generally, the down hole assembly is connected to a work string concentrically located within a casing string. In one embodiment, the down hole assembly comprises a mandrel operatively connected to the work string, with the mandrel having an opening therein. A pad member is received within the opening, with the pad member having a groove formed therein. Also provided is a wire brush means, operatively positioned within the groove of the pad member, for cleaning the internal diameter of the casing string.

The down hole assembly further comprises a biasing member, operatively positioned between the mandrel and the pad member, adopted for biasing the wire brush means against the inner diameter of the well bore. In the preferred embodiment, the wire brush means comprises a wire bundle having a first end and a second end, a brace disposed about the second end of the wire bundle, and wherein the brace is disposed within the groove of the pad member.

The brace herein disclosed includes an open end and a closed end, with the closed end having disposed therein the second end of the wire bundle, and wherein the open end and the closed end cooperate to form a triangular shaped profile. The groove will also contain a triangular shaped profile adapted to slidably receive the triangular brace.

In the preferred embodiment, the mandrel contains a second of slot, and wherein the down hole assembly further comprises a second pad member adapted to be received within the second slot, the second pad containing a second groove formed therein. A second wire brush means, operatively positioned within the second groove of the pad member, is also provided for cleaning the internal diameter of the casing string.

The down hole assembly may also contain a centralizer means, operatively adopted to the work string, for centralizing the mandrel within the casing string. A dove tail means, operatively associated with the mandrel, is also included for selectively adapting the wire brush means onto the work string.

In the preferred embodiment, the first and second wire brush means are arcuate, and wherein said first wire brush means is disposed about the periphery of the mandrel to cover a first 180 degree phase and wherein the second wire brush means is disposed about the periphery of the mandrel to cover a second 180 degree phase so that the first wire brush means and the second wire brush means cover a 360 degree phase about the mandrel. In another embodiment, a plurality of wire brush means may be placed about the periphery of the mandrel, with the wire brush means being staggered circumferentially in relation to each other so that the wire brushes have an effective coverage area of 360 degrees.

Also disclosed herein is a method of cleaning a casing string. The method comprises lowering a work string within the casing string. The work string will have provided therewith a down hole cleaning apparatus operatively associated with the work string. The wire bundle of the cleaning apparatus will be urged against the inner diameter of the casing string via the spring to allow for constant pressure of the brushes against the casing wall at all times. The method provides for cleaning the inner diameter of the casing string as the work string is lowered.

The method further comprising rotating the work string, and thereafter, lowering the work string. The operator may then circulate a drilling fluid through the inner diameter of the work string. The work string may be stationary or rotating during circulation.

In one embodiment, the well casing has a horizontal section so that a low side of the well casing and a high side of the well casing is created. In this embodiment, the apparatus includes a centralizer operatively associated with the work string. Also included will be a second cleaning apparatus, with the first cleaning apparatus covering a 180 degree phase and the second cleaning apparatus covering a complimentary 180 degree phase so that the entire 360 degree periphery is covered.

The method would further comprise lifting the apparatus from the low side of the inner diameter of the well casing with the centralizer. Also, the wire bundle of the first cleaning apparatus is urged against the low side of the inner diameter of the well casing with the spring at a constant force. Simultaneously therewith, the wire bundle of the second cleaning apparatus is urged against the high side of the inner diameter of the well casing with its spring at a constant force so that both the low side of the casing and the high side of the casing will be cleaned.

In a second embodiment, an apparatus for cleaning an inner diameter of a casing string is disclosed. In this embodiment, the down hole assembly comprises a mandrel having a first end and a second end, with the first end of said mandrel being configured to be connected to an opened end of a first tubular member and the second end of the mandrel being configured to be connected to an opened end of a second tubular member. The mandrel contains a first helical opening.

The apparatus further contains a first helical pad configured to be positioned within the first helical opening, with the helical pad having a groove therein. A wire brush member is inserted within the groove and a first spring is inserted between the first helical pad and the mandrel, with the spring biasing the helical pad radially outward.

The apparatus further contains a dove tail means, operatively associated with the mandrel, for selectively adapting the first second helical pad member with the mandrel. The dove tail means comprises the first tubular member having an opened end with an annular ring formed thereon that engages a first lip extending from the first helical pad, with the first lip being configured to adapt to the annular ring so that the first helical pad is held in place by the annular ring.

The apparatus further comprises a second helical opening formed on the mandrel and a second helical pad configured to be positioned within the second helical opening. The second helical pad will have a series of annular ribs disposed thereon. A second spring is inserted between the second helical pad and the mandrel, with the second spring biasing the second helical radially outward. In this embodiment, the dove tail means further comprises the second tubular member having an opened end with an annular ring formed thereon that engages the first lip so that the second helical pad is held in place by the annular ring.

The apparatus may further comprise a third helical opening formed on the mandrel, with the third helical pad being configured to be positioned within the third helical opening. The third helical pad contains a series of annular ribs. A third spring is inserted between the first helical pad and the mandrel, with the spring biasing the helical pad radially outward. A fourth helical opening may also be included, with a fourth helical pad configured to be positioned therein. The fourth helical pad will have a series of annular ribs. A fourth spring is inserted between the second helical pad and the mandrel for biasing the fourth helical pad radially outward.

In the preferred embodiment, the wire brush member comprises a wire bundle having a first end and a second end, a brace disposed about the second end of the wire bundle, and the brace is disposed within the groove of the pad member. The brace comprises an open end and a closed end, with the closed end having disposed therein the second end of the wire bundle, and wherein the open end and the closed end cooperate to form a triangular shaped profile. The groove will also have an angular shaped profile adapted to slidably receive the wedge of the brace. The first and second wire brush members will be arcuate. In one embodiment, the first wire brush member is disposed about the periphery of the mandrel to cover a first phase and wherein the second wire brush member is disposed about the periphery of the mandrel to cover a second phase.

A method of cleaning a casing string with this second embodiment is also disclosed. The method comprises lowering a work string within the inner diameter of the casing string and providing a cleaning apparatus operatively associated with the work string. The method includes urging the wire brush member against the inner diameter of the casing string with a first and second spring biasing a helical pad member and cleaning the inner diameter of the casing string. The method further comprises rotating and lowering the work string. A fluid may be circulated through the inner diameter of the work string which in turn will cause the fluid to be returned on the annulus side, with the fluid being channeled between and through the helical pad.

In one embodiment, the well casing has a highly deviated section so that a low side of the well casing and a high side is created, and the apparatus further comprises a centralizer operatively associated with said work string, with the first helical pad covering a first phase and the second helical pad covering a second phase. The method further comprises lifting the apparatus from the low side of the inner diameter of the well casing with the centralizer, urging the wire brush member of the first helical pad against the low side of the inner diameter of the well casing with said spring at a constant force and urging the wire brush member of the second helical pad against the high side of the inner diameter of the well casing with the spring at the constant force.

In a third embodiment, which is the preferred embodiment of this application, a down hole assembly is disclosed. The down hole assembly comprises a mandrel having a first opening, with the first opening having a first lip. The mandrel also includes an indentation. A first wire brush is inserted into the first indentation. A first spring is positioned between the first wire brush and the first indentation, with the first spring biasing the first wire brush outward. The mandrel also includes an aperture.

The assembly further contains a first sleeve disposed about the mandrel, with the first sleeve engaging the first wire brush member. A first locking dog is disposed in the aperture so that the first end of the first locking dog engages the first sleeve.

The mandrel may further contain a second indentation, and wherein the assembly further comprises a second wire brush inserted into the second indentation. A second spring is positioned between the second wire brush and the second opening, with the second spring biasing the second wire brush outward. A second sleeve may be disposed about the mandrel, with the second sleeve engaging the second wire brush member. A second locking dog may be disposed in a second aperture in the mandrel, with the second locking dog having a first end engaging the second sleeve.

In the most preferred embodiment, the first and second locking dog comprises a cylindrical member having an external threads engaging an internal thread on the aperture of the mandrel, with the cylindrical member forming a chamber. In the preferred embodiment, a spring is contained within the chamber. The locking dog further contains a stem having a shoulder thereon, with the stem engaging a depression in the first and second sleeves.

In one embodiment, the first wire brush and the second wire brush comprises a wire bundle and a brace disposed about a second end of the wire bundle, and wherein the brace is disposed within a groove in the pad member. The brace may have a closed end having disposed therein the second end of the wire bundle, and wherein an open end of the brace and the closed end cooperate to form a triangular shaped profile.

In one embodiment, the groove has an angular shaped profile adapted to slidably receive the triangular shaped profile of the brace. Additionally, in one of the embodiments, the first opening and the second opening are helically shaped, and wherein the first and second wire brush members are helically arranged. In still another embodiment, the first and second wire brush members are arcuate, and wherein the first wire brush member is disposed about the periphery of the mandrel to cover a first phase and wherein the second wire brush member is disposed about the periphery of the mandrel to cover a complimentary second phase.

Additionally, in one of the embodiments herein disclosed, the sleeve contains a series of spiral blades for centralizing the mandrel in the inner diameter of the casing string. Further, a centralizer may be formed on the mandrel for centralizing the mandrel in the inner diameter of the casing string.

A method of cleaning a casing string with the third embodiment is also disclosed. The method comprises lowering a work string within an internal portion of the casing string. A cleaning apparatus is attached to the work string, with the apparatus comprising: a mandrel having an opening, with the mandrel having an aperture therein, and wherein the opening has a first lip; a wire brush inserted into the opening; a spring positioned between the wire brush and the opening, with the spring biasing the wire brush outward; a sleeve disposed about the mandrel, with the sleeve engaging the wire brush; a locking dog disposed in an aperture disposed on the mandrel, with the locking dog having a first end engaging the sleeve.

The method includes urging the wire brush member against the internal portion of the casing string with the spring and cleaning the internal portion of the casing string. The method further includes rotating the work string and lowering the work string. A fluid is circulated through the internal portion of the work string, with the fluid being channeled through the wire brush pad in the annulus area.

In one embodiment, the well casing has a highly deviated section so that a low side of the well casing and a high side is created. The apparatus further comprises: a second wire brush member inserted into a second opening in the mandrel; a second spring positioned between the second wire brush member and the second opening, with the second spring biasing the second wire brush outward; a second sleeve disposed about the mandrel, the second sleeve engaging the second wire brush member; and, a second locking dog disposed in a second aperture, with the second locking dog having a first end engaging the second sleeve; and a centralizer operatively associated with the mandrel, with the first wire brush pad covering a first phase and the second wire brush pad covering a second phase. In this embodiment, the method includes lifting the apparatus from the low side of the inner diameter of the well casing with the centralizer. The first wire brush pad is urged against the low side of the inner diameter of the well casing with the spring at a constant force and the second wire brush pad is urged against the high side of the inner diameter of the well casing with the spring at the constant force.

An advantage of the present invention includes the ability to thoroughly clean the internal diameter of the casing of a course material such as cement while at the same time being able to scour the casing of thin films left by oil base and synthetic muds that contain hydrocarbons. Another advantage includes that the design allows easy replacement of the components so that if a brush becomes worn, a new brush may be easily inserted therein at the rig location.

Another advantage includes use of wire bristles that are of sufficient hardness to allow for the scraping of the inner diameter of the casing. Yet another advantage includes a staggered configuration of the brushes that allows for the entire 360 degree periphery of the casing to be cleaned with the upper set of brush pads or upper scrapers pads. Another advantage is that the staggered configuration of lower scraper pads or lower brush pads that allows for the entire 360 degree periphery to be cleaned. Still yet another feature is that the device may be used in highly deviated and/or horizontal wells.

An advantage of the present invention is that the helical pad allows for channeling of well bore fluid in the annulus area. Another advantage is that the helical brushes and scraper pads (also referred to as ribs) allow for better cleaning of inner diameter of casing string. Yet another advantage is the scraper pads, and brushes are interchangeable with each other.

Another advantage is that the novel locking mechanism allows for the locking of the brush pads without the need for make up via traditional thread means. Another advantage is that the mandrel can be forged from a single stock which will make the apparatus stronger in application. Still yet another feature is the novel locking dog' use with the cleaning pads which allows for ease of manufacture and use. This embodiment does not require torquing of the mandrel, and therefore, this gives the advantage of having a stronger tool since the torquing process may weaken the assembly in repetitive use, over torquing, etc.

A feature of the present invention includes a novel locking mechanism brace that allows the clamping of a bundle of wire bristles. Another feature is that the novel locking mechanism includes triangular grooves formed within the pad that cooperate with a triangular brace profile fitted therein. Yet another feature is the dove tail locking means for selectively locking the pad onto the mandrel.

Another feature includes a spring loaded pad that urges the wire brush against the wall of the casing at a constant pressure. Thus, in a highly deviated well, both the high side and low side of the well will be cleaned. Still yet another feature is use of a centralizer that allows for the wire brush to be centered within well. This feature keeps both brushes centralized which in turn keeps the same pressure about the circumference of the casing walls.

Still yet another feature of the present invention includes use of helical brushes inserted into a helical pad. Another feature is the helical ribs that act to clean and centralizer the tool in a well bore. Yet another feature is that in one embodiment an upper row of helical brushes is used and lower row of helical ribs (also referred to as scraper pads) is used. Still yet another feature is that sleeves may serve as a centralizer.

DETAILED DESCRIPTION OF THE PREFERRED EMBODIMENTS

Figure 1:
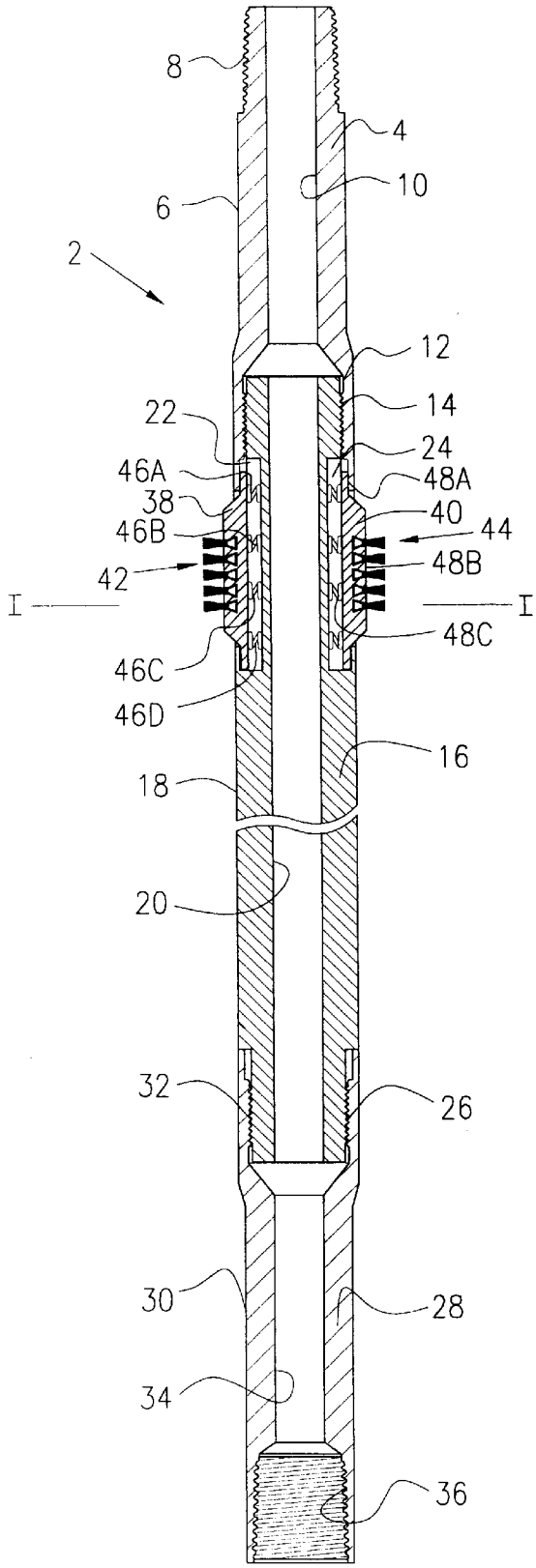
FIG. 1 is a cross-sectional view of the down hole cleaning assembly shown in a first phase.

Referring now to FIG. 1, a cross-sectional view of the down hole cleaning assembly 2 shown in a first phase will now be described. Generally, the assembly 2 includes a first mandrel 4 that has an outer diameter surface 6 that includes an external thread profile 8 The external thread profile 8 may be attached to a work string (not shown) such as drill pipe. It should be understood that other types of work strings are available such as snubbing pipe, coiled tubing, production strings, etc. The first mandrel 4 will have a first internal bore 10 that extends to the second internal bore 12 that will have contained thereon internal thread means 14.

The assembly 2 contains a second mandrel 16 having an outer diameter 18 and an inner bore 20. The outer diameter 18 will have a series of openings formed therein, with FIG. 1 showing opening 22 and opening 24. It should be noted that in the preferred embodiment, there will be two rows of openings, with the first row along line A—A of FIG. 1 and the second row along line B—B of FIG. 6. Each row will contain three openings.

The outer diameter 18 may contain other openings that will be described later in the application. The outer diameter 18 will also contain the external thread means 26. In the embodiment shown in FIG. 1, the second mandrel 16 is made up to a third mandrel 28 The third mandrel 28 will have an outer diameter 30 that in turn extends radially inward to the internal threads 32 which in turn extends to the inner bore 34 that in turn leads to the internal threads 36. The third mandrel 28 may be attached to another down hole tool such as a bit.

The assembly 2 will have included the pad members 38. 40 that are operatively positioned within the openings 22, 24 respectively. The pad members 38, 40 will have a plurality of grooves formed therein with the grooves containing wire brush means 42,44 for cleaning the internal diameter of a casing string. The wire brush means 42, 44 is generally a wire bristle arrangement that is commercially available from Spiral Brush, Inc. under the name steel wire. The bristles are manufactured from carbon or stainless steel.

The pad members 38 are operatively associated with biasing means 46.48 for urging the pads 38, 40 (and in turn the wire brush means 42, 44) outwardly with respect to the casing. In the preferred embodiment, each opening will have four springs, including, a first spring 46A/48A, second spring 46B/48B, and the third spring 46C/48C. The spring loaded pads will allow for constant pressure of the brushes against the casing wall at all times. It should be noted that additional springs may be employed, for instance, when the device used has a large diameter so that more force is needed to adequately bias the pads.

The invention may have a plurality of openings within the outer diameter 18 for placement of additional pad and wire brush means as previously set out. With a staggered configuration of pads about the body of the mandrel 16, a 360 degree circumference about the inner diameter of the casing may be cleaned. This will be further explanation in reference to FIG. 6.

Figure 2:
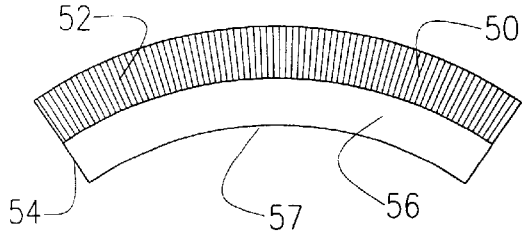
FIG. 2 is a top view of the wire brush member of the preferred embodiment of the present invention.

Referring now to FIG. 2, a top view of the wire brush member 42, 44 of the present invention will now be described in greater detail. The wire brush member 42, 44 includes a bundle of wires that can be purchased from Spiral Brush. The bundle of wires may be comprised of a carbon or stainless steel material. As depicted in FIG. 2, the bundle of wires 50 will have a first end 52 and a second end 54. The linear bundle of wires 50 is wrapped about a center rod 55. The second end 54 will be encapsulated within a brace 56, with the brace 56 tightly clamping about the second end 54 and rod 55 so that the wires are held together. Further, the brace 56 is arcuate with respect to radial surface 57 and has generally the same radius of curvature as that of the mandrel 16.

Figure 3A:
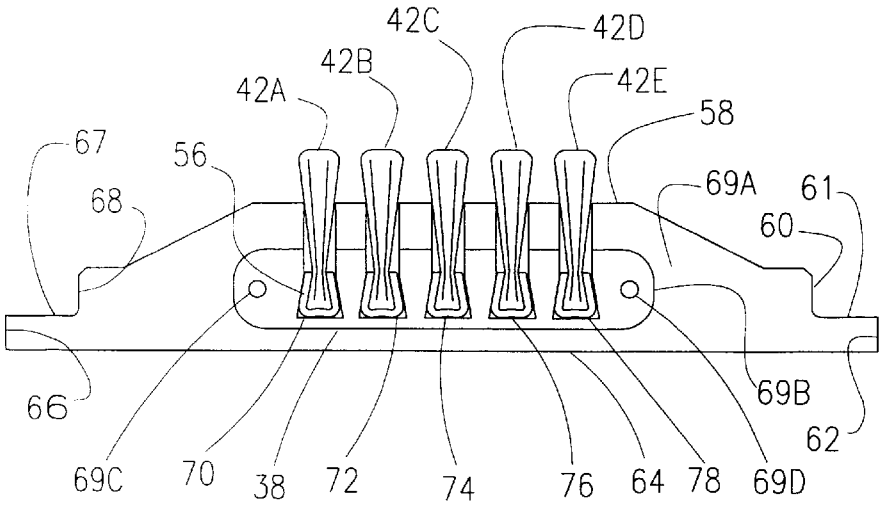
FIG. 3A is an end view of the pad member with wire brush member inserted therein of the preferred embodiment.

In reference to FIG. 3A, an end view of the pad member 38 with wire brush means 42 inserted therein is shown. In the preferred embodiment, the pad member 38 contains an outer surface 58 that slopes to first shoulder 60 that in turn extends to a surface 61 and then to a second shoulder 62. The second shoulder 62 advances to the internal surface 64 that in turn extends to a third shoulder 66 and surface 67 which in turn stretches to the fourth shoulder 68. The outer surface 58 will contain a series of grooves 70. 72, 74, 76, 78 that are formed in the pad 38 so that series of triangular profiles are formed therein. Thus, the braces 56 may be laterally placed therein.

Figure 3B:
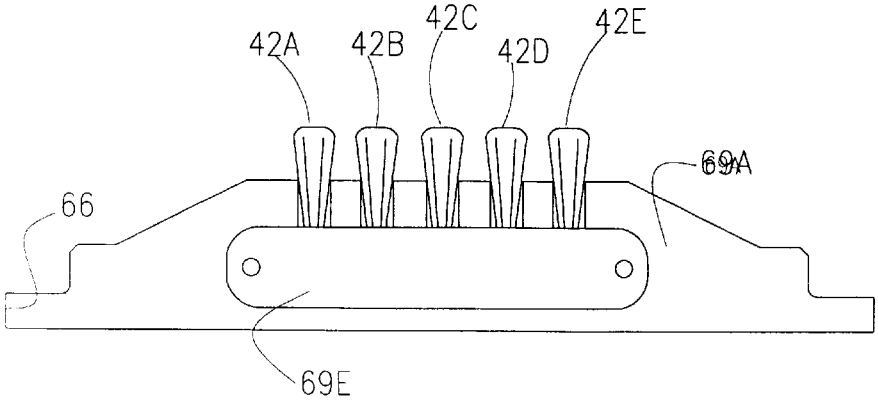
FIG. 3B is an illustration of FIG. 3A with the end plate inserted thereon.

Also, the present invention teaches having a groove 69B formed within the end face 69A. The end face 69A will have two openings 69C & 69D that will receive an attachment means such as a set screw. In FIG. 3B, the illustration of FIG. 3A is depicted with an end plate 69E operatively associated therewith. Thus, the end plate 69E will be inserted within the groove 69B, and will further have a pair of set screws that are inserted into the openings 69C & 69D. With the end plate in place, the wire brush means 42 are effectively locked into position so that they can not inadvertently back-out during operation. An end plate may be placed on all of the pad members.

Figure 4:
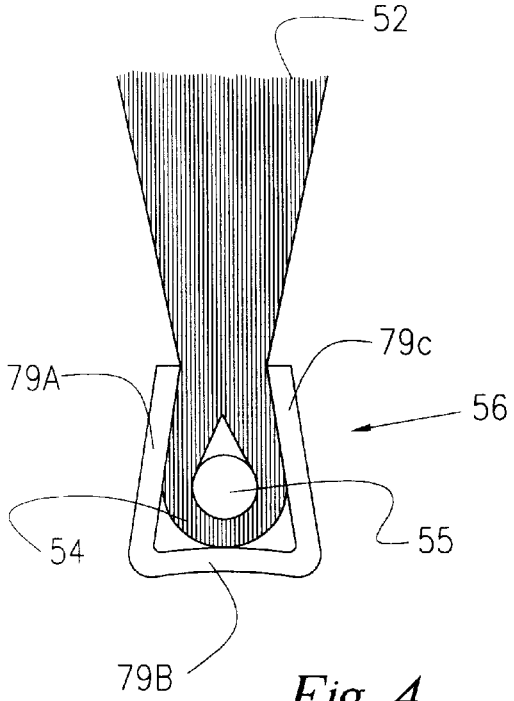
FIG. 4 is a side view detail of the wire brush member clamped with the brace member of the preferred embodiment.

With reference to FIG. 4, a side view detail of the wire brush means 42,44 clamped with the brace member 56 of the present invention will now be described. The brace 56 may comprise a first leg 79A, a second leg 79B, and a third leg 79C, with the legs 79A, 79C bent in relation to each other so that a triangular profile is formed as well as clamping the second end 54 of the wire bundle. As stated earlier, the wire bundle will generally have a first end 52 that will serve to clean the casing. As shown, the clamping effect of the brace 56 causes the wire end 52 to expand which enhances the effectiveness of the wire scraping the casing wall as well as serving to clutch the wire bundle and rod 55 in place.

Figure 5:
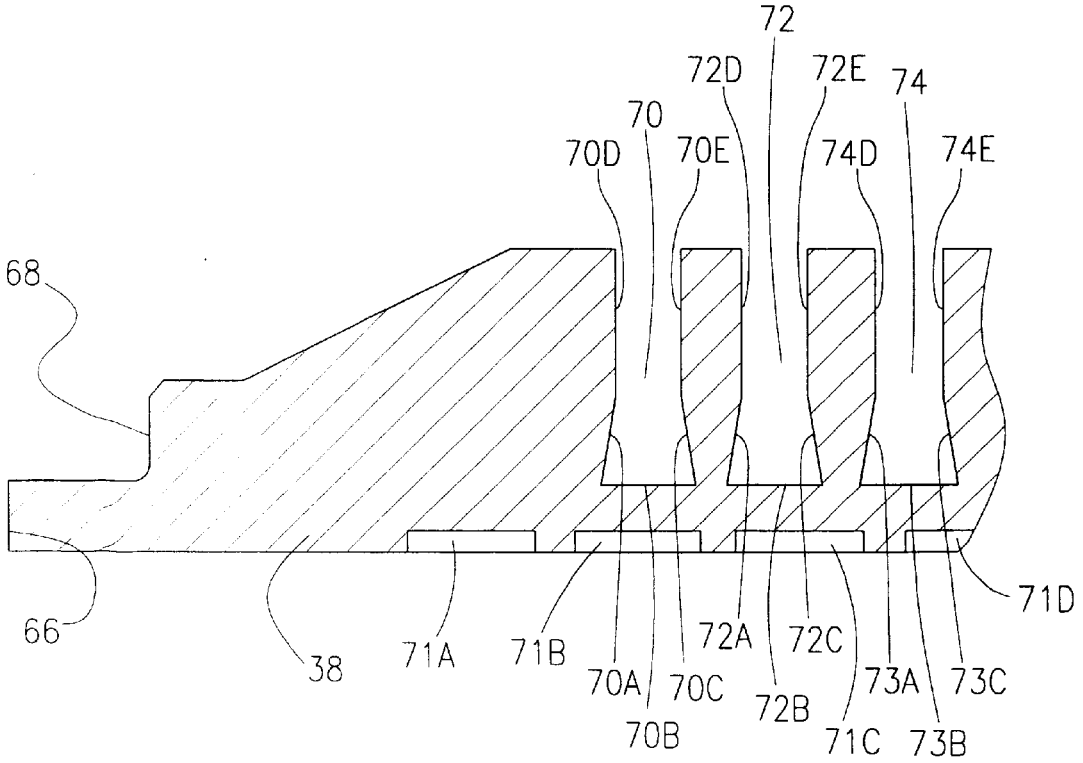
FIG. 5 is a side view detail of the pad member of FIG. 3.

In reference to FIG. 5, a side view detail of the pad member 38 of FIG. 3 is shown. It should be noted that like numbers appearing in the various figures correspond to like components. Thus, the pad member 38 will have a series of grooves 70–78. The individual grooves will have a first wall 70A, a second wall 70B and a third wall 70C with the three walls forming a triangular profile that is essentially patterned after the brace 56 so that the brace 56 may be slidably disposed therein. The triangular shaped profile allows for lateral placement of the brace 56 therein while at the same time securing the brace 56 from radial release from the grooves 70–78. The grooves 70–78 may also contain radial surfaces 70D, 70E, 72D, 72E, 74D and 74E.

FIG. 5 also depicts the channels 71A–D that may be included which receive and cooperate with the springs. Although not shown, the series of rows may be arranged in an inclined orientation relative to the axial bore which gives the series of rows a spiral effect. The inclined orientation allows for the displacement of the particles and compounds that are on the wall of the casing to be more easily channeled as the device is either being lowered into the well, raised from the well, or being rotated in the well.

The embodiment of FIG. 5 may also include an end plate member that contains two openings for placement of set screws to affix the plate member onto the pad. The plate member will hold the brushes in place and prevent the brushes from sliding out of the grooves.

Figure 6:
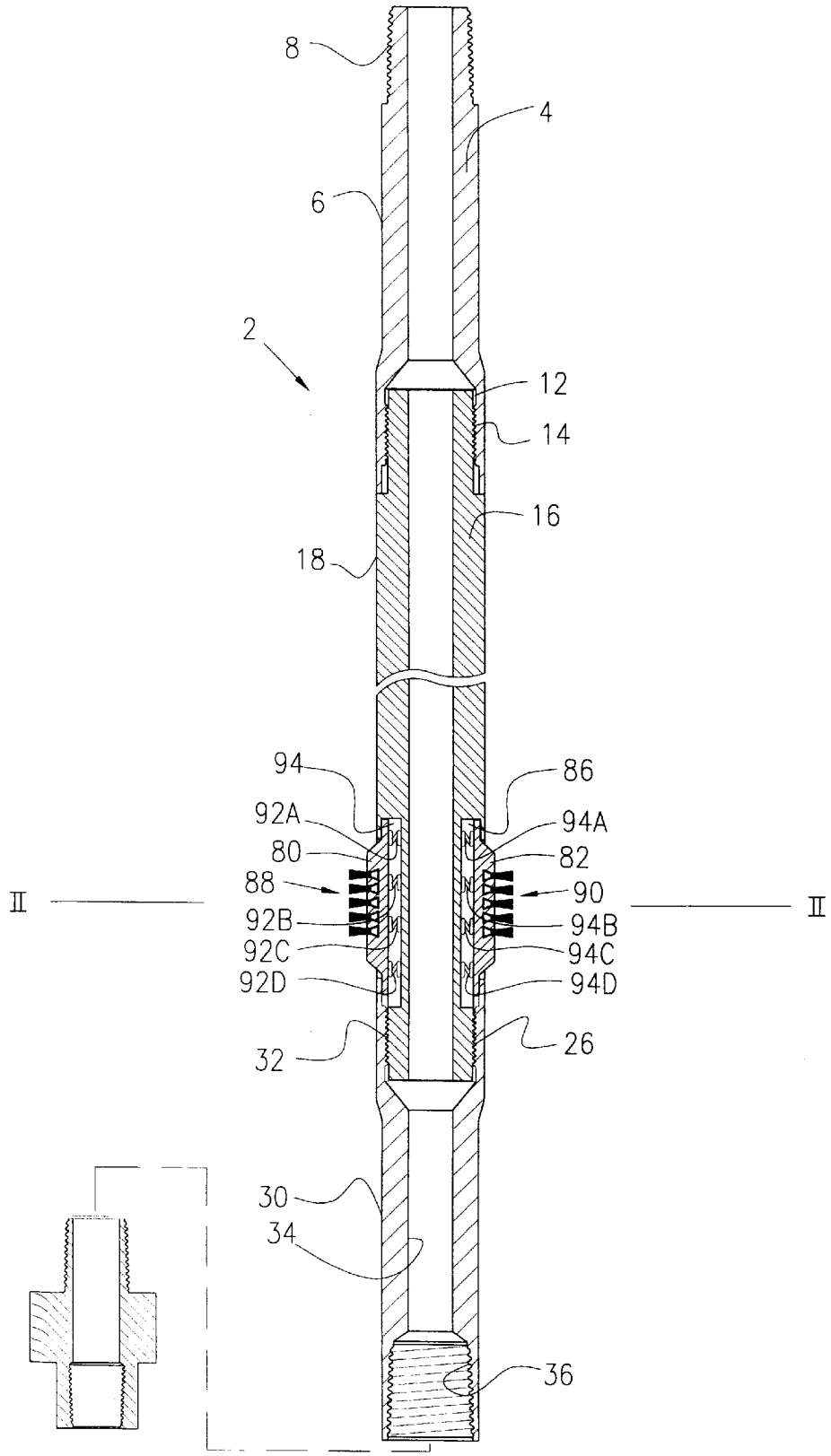
FIG. 6 is a cross-sectional view of the down hole cleaning assembly shown rotated to a second phase.

Referring now to FIG. 6, a cross-sectional view of the down hole cleaning assembly 2 shown rotated to a second phase will now be described. Thus, the drawing shows the second row including the pad member 80 and pad member 82 that will be inserted within the openings 84, 86. The pad members 76, 78 will have associated therewith the wire brush means 88 and 90, respectively for cleaning the internal diameter of the casing string. As set out earlier, the wire brush means 84, 86 will include the wire bundles clamped via a brace.

The pad member 76 will be urged outward toward the casing inner wall via the springs 92A 92B, 92C and the pad member 78 will be urged outward toward the casing inner wall via springs 94A, 94B. 94C. As previously set forth, the springs 92A–C and 94A–C will urge the wire brush against the wall of the casing at a constant force. Thus, if the work string is being lowered through dog legs, or other highly deviated portions of the well, the springs will allow the retraction or urging as is necessary.

Figure 7:
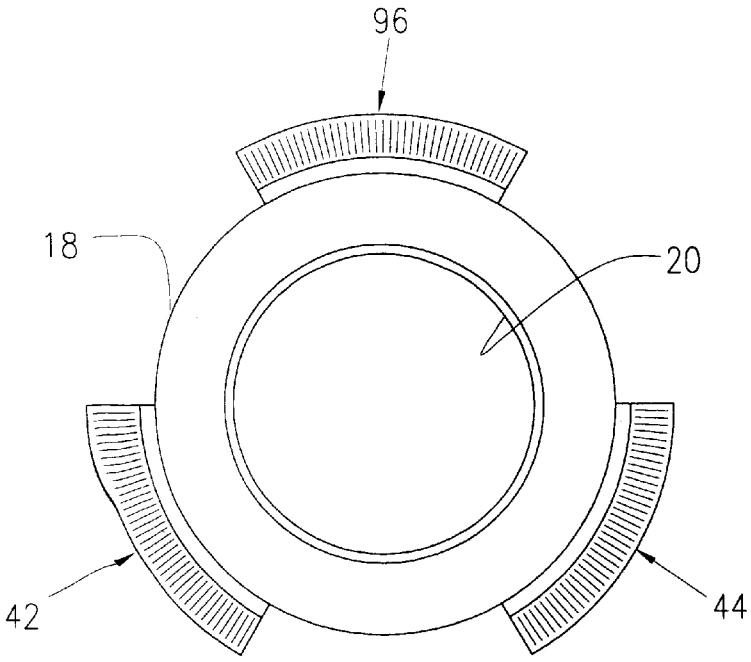
FIG. 7 is a cross-sectional view of line A—A taken from FIG. 1.

The illustration of FIG. 7 depicts a cross-sectional view of line A—A taken from FIG. 1. Thus, the brush means 42 and 44 are shown along with the brush means 96 in the first row. It should be noted that while three brush means 92 are shown in FIG. 7, the actual number may vary depending on numerous variables such as hole size, work string, etc. The brush means 92 will be included within an opening along the pad and spring as previously described. The three brush means will provide for an effective radial cleaning phase area of 360 degrees.

Figure 8:
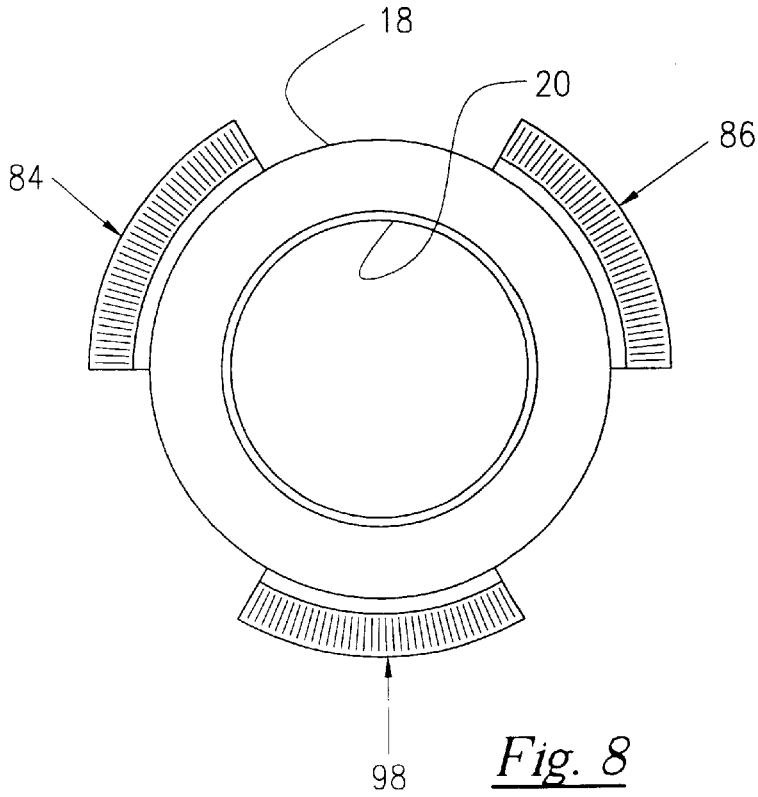
FIG. 8 is a cross-sectional view of line B—B taken from FIG. 6

In FIG. 8, the drawing illustrates a cross-sectional view of line B—B taken from FIG. 6 wherein FIG. 6 depicts three brush means, namely 84, 86 and 98 in a second row. The construction of the pads, openings, springs and brush means is similar to those described in FIGS. 1 through 7. The three brush means will provide for an effective radial cleaning phase area of 360 degrees. As seen in FIG. 8, the individual brush means 84, 86, 94 are disposed in a different longitudinal phase when compared to the brush means 42, 44, 92 so that a staggered 360 degree coverage of the inner diameter may be accomplished during an operational trip into the casing string i.e. the entire inner diameter circumference will be cleaned.

Figure 9:
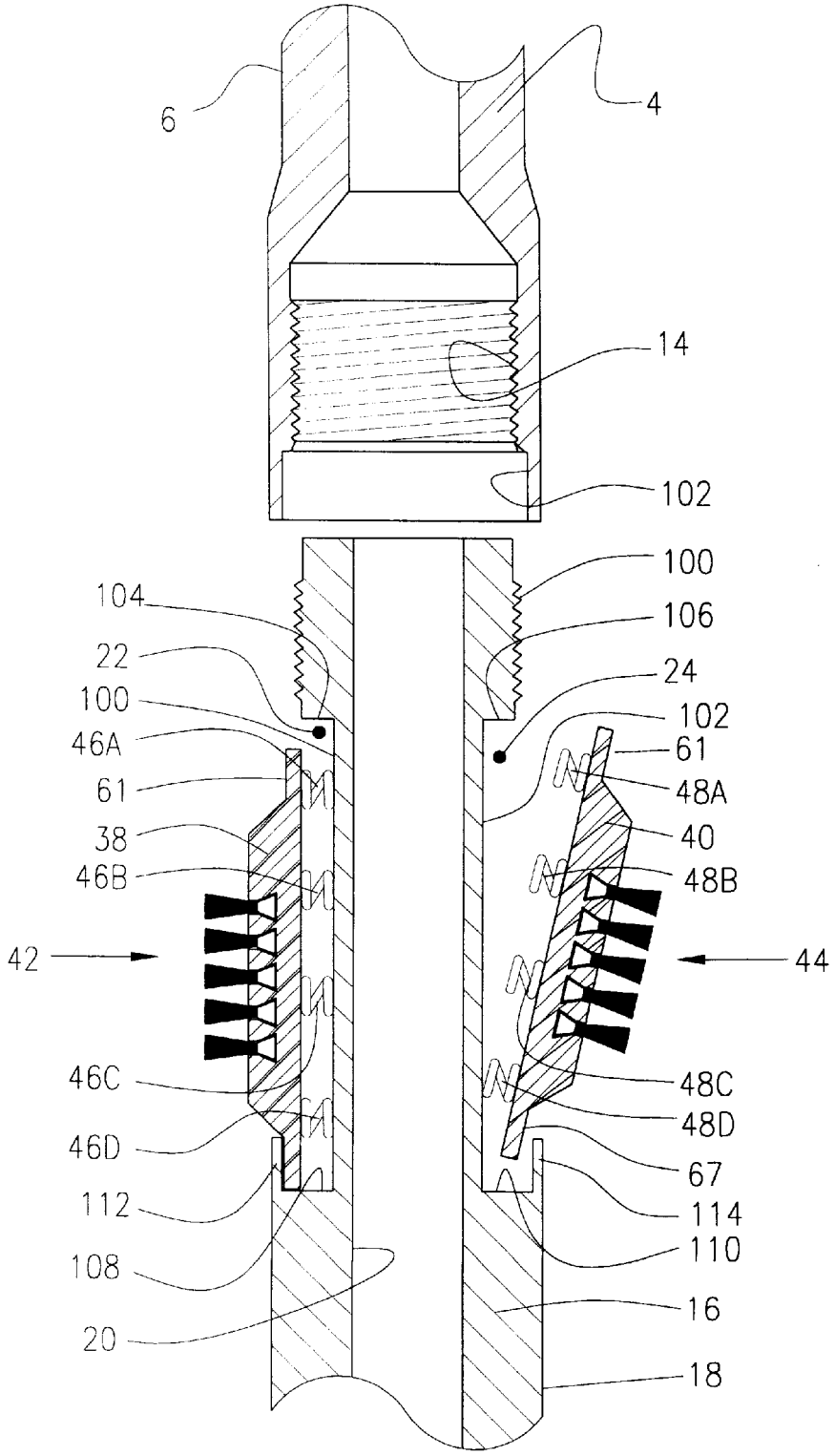
FIG. 9 is a cross-sectional view of an embodiment of the present invention that depicts dove tail means for attaching the pads to the down hole cleaning assembly.

FIG. 9 is a cross-sectional view of an embodiment of the present invention that depicts dove tail means for attaching the pads to the down hole cleaning assembly 2. More particularly, the first mandrel 4 will have the internal threads 14 that cooperate with the external threads 100 of the second mandrel 16. The internal threads 14 lead to a inner bore surface 102.

The external threads 96 extend to the openings 22, 24 that have radial shoulders 104. 106. The openings 22, 24 are generally slots that are formed on the periphery of the mandrel 16 and are adapted to receive the pads 38, 40 as previously described. The slots formed will terminate at the shoulders 108,110 that in turn extends to the lip 112, 114. The lips 108, 10 then lead to the outer diameter surface 18. It should be noted that while two openings 22, 24 are shown in FIG. 9, the preferred embodiment will contain three staggered openings about the periphery as shown in FIG. 7.

Therefore, when the tool is to be assembled, the operator may place the springs 46A–46C and 48A–46C within the openings 22, 24. The pads 38, 40 are then placed within the openings 22, 24. The surface 67 of the pad member 40 is placed within the opening 24 such that the surface 67 and lip 110 abut each other and with the pads 38, 40 up against the shoulder 104 and 106. Next, the first mandrel 4 is threadedly connected with the second mandrel 16 by making up threads 14 with threads 96. The inner bore surface 97 will slide-over the lip 61. With the lip 61 in place, the inner bore surface 97 will hold the pads 38, 40 so that the pads may be biased radially outwardly via springs 46A–46C and 48A–48C. Meanwhile, the surface 67 will engage the lip 108, 110 so that the pad members 38, 40 are held in position.

Thus, the individual pad members may be replaced on location by threadedly removing the mandrel 4, withdrawing the old pad member, and thereafter placing a new pad member with new brush means thereon into the openings. Next, the operator could then threadedly make up the mandrel 4 onto mandrel 16 as previously set forth.

Also, the mandrel 28 will have similar thread means with an inner bore surface for making up to the mandrel 16 so that the second series of pad members 76, 78 may be similarly dove tailed for selectively adapting said pad members 76, 78 with the mandrels 16, 28.

Figure 10:
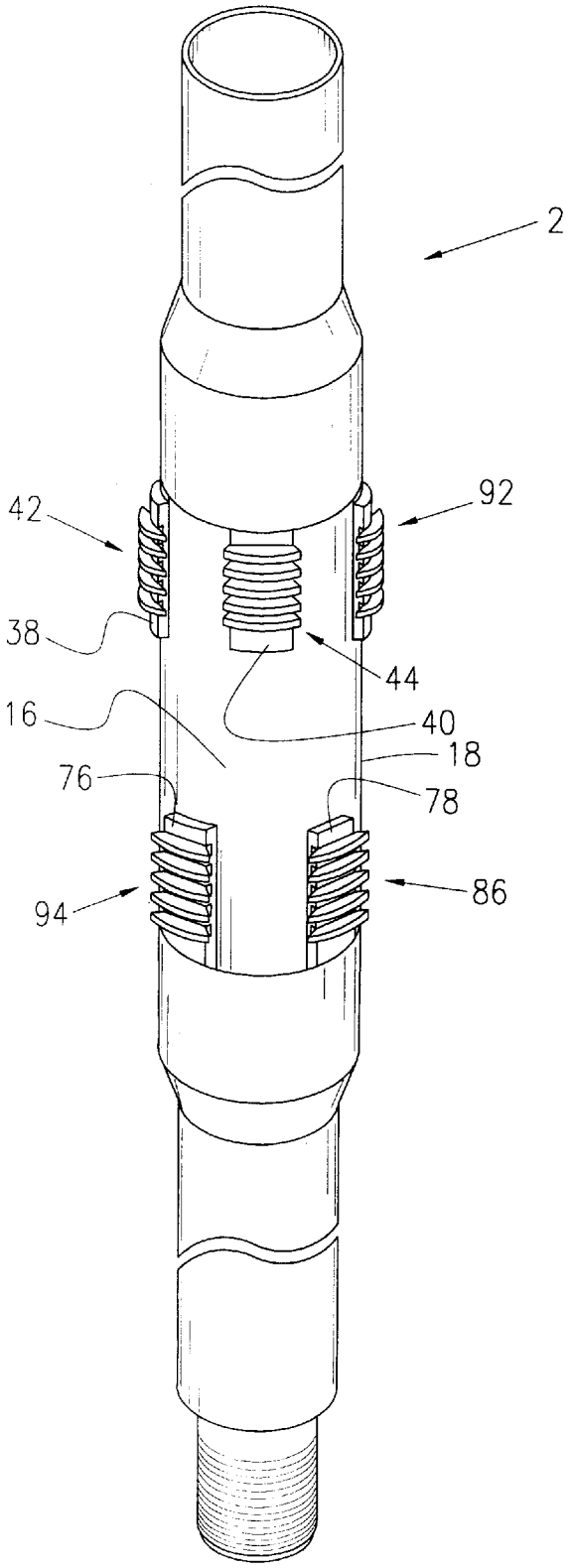
FIG. 10 is a perspective view of the down hole cleaning assembly of the preferred embodiment of the present invention.

The invention is illustrated in a perspective view in FIG. 10. Thus, in the preferred embodiment, the brush means 42, 44, 92 are positioned in a first row while the brush means 84, 86, 94 are positioned in a second row. Also, the FIG. 10 depicts the pads 38, 40, 76, 78 disposed within openings contained on the mandrel 16 as previously described.

Figure 11:
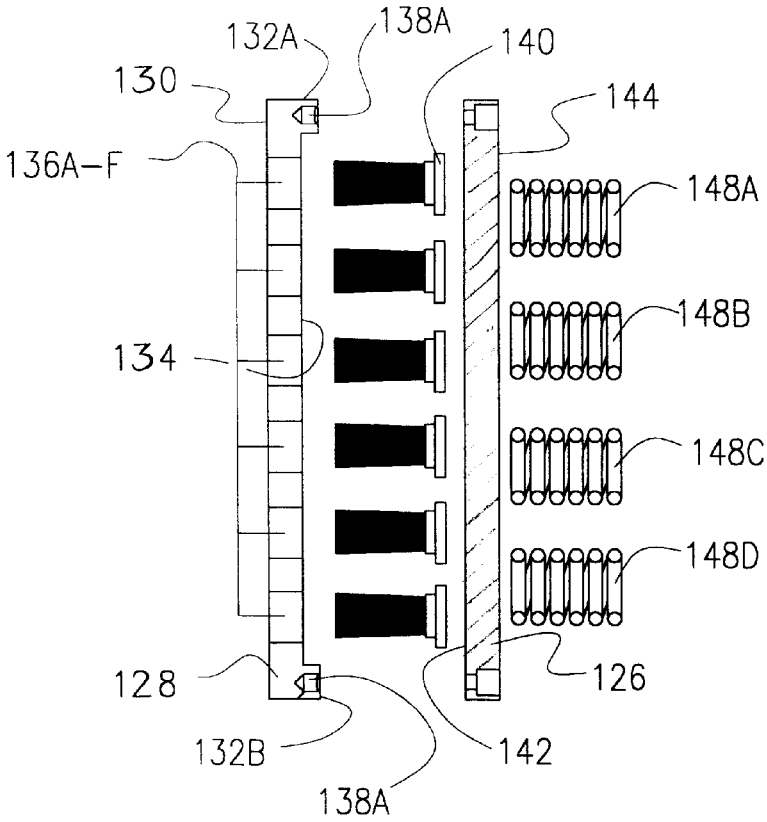
FIG. 11 is a disassembled cross-sectional view of a second embodiment of the pad and wire brush member.

There is yet another embodiment possible with the teachings of the present invention. Referring now to FIG. 11, the embodiment includes a different type of wire brush means 122 operatively associated with the pad member 124. The pad member 124 includes the first plate 126 and the second plate 128 which allows for the back side placement of the brush means 122 through the second plate 128.

The pad member 124 of FIG. 11 will be received within the openings 22, 24, 84, 86 etc. previously mentioned. The plates 126, 128 are arcuate so that they fit into the contour of the outer diameter of the mandrel 16. The second plate 128 will have an outer surface 130 that extends to the ledges 132A–B which in turn extends to the inner surface 134. The second plate 128 has disposed therein the openings 136A–F and the ledge 132 has openings 138A–B.

Also depicted in FIG. 11 is the wire brush means 122 for cleaning the internal diameter of said casing string as previously described. The wire brush means 122 is also commercially available from Spiral Brush Inc. In this embodiment, the individual wire brush means 122 are disposed through the openings 126A–F and are generally circular arranged about a base 140. The base 140 is of a diameter greater than the diameter of the opening 136 so that the wire brush means 122 can not pass therethrough.

The first plate 126 contains the first surface 142 that stretches to a second surface 144. The second surface 144 will have disposed therein openings 146A 146B. A fastener, such as a screw, may be placed therethrough and be operatively attached with the second plate 128 via the openings 138A, 138B. In this manner, the wire brush means 122 will fit through the openings and once the plates 126 and 128 are fastened together, the wire brush means 122 are locked into position.

Figure 12:
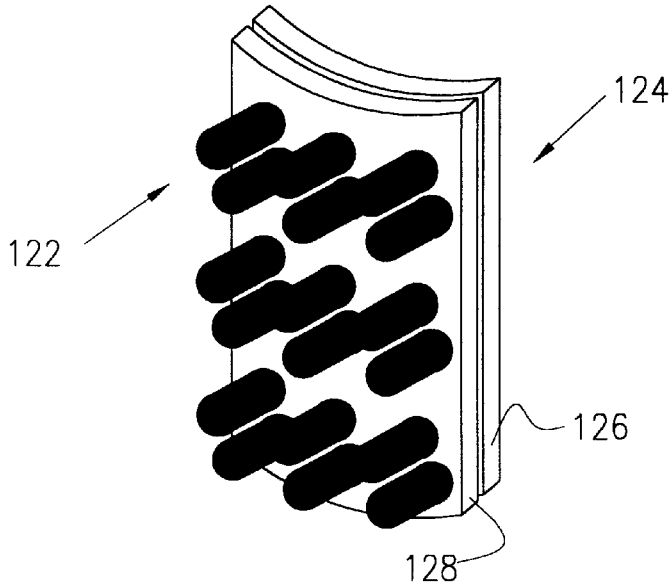
FIG. 12 is a perspective view of the pad and wire brush member of FIG. 11.

The spring means 148A–D will be positioned so that one end of the spring is up against the surface 144 while the other end is against the surface 102, for instance. Thus, the spring means 148A–148D will bias the pad member 124 axially outward into engagement with the wall of the casing string as previously set forth. FIG. 12 is a perspective view of the pad 124 and wire brush member 122 of FIG. 11 assembled.

Figure 13:
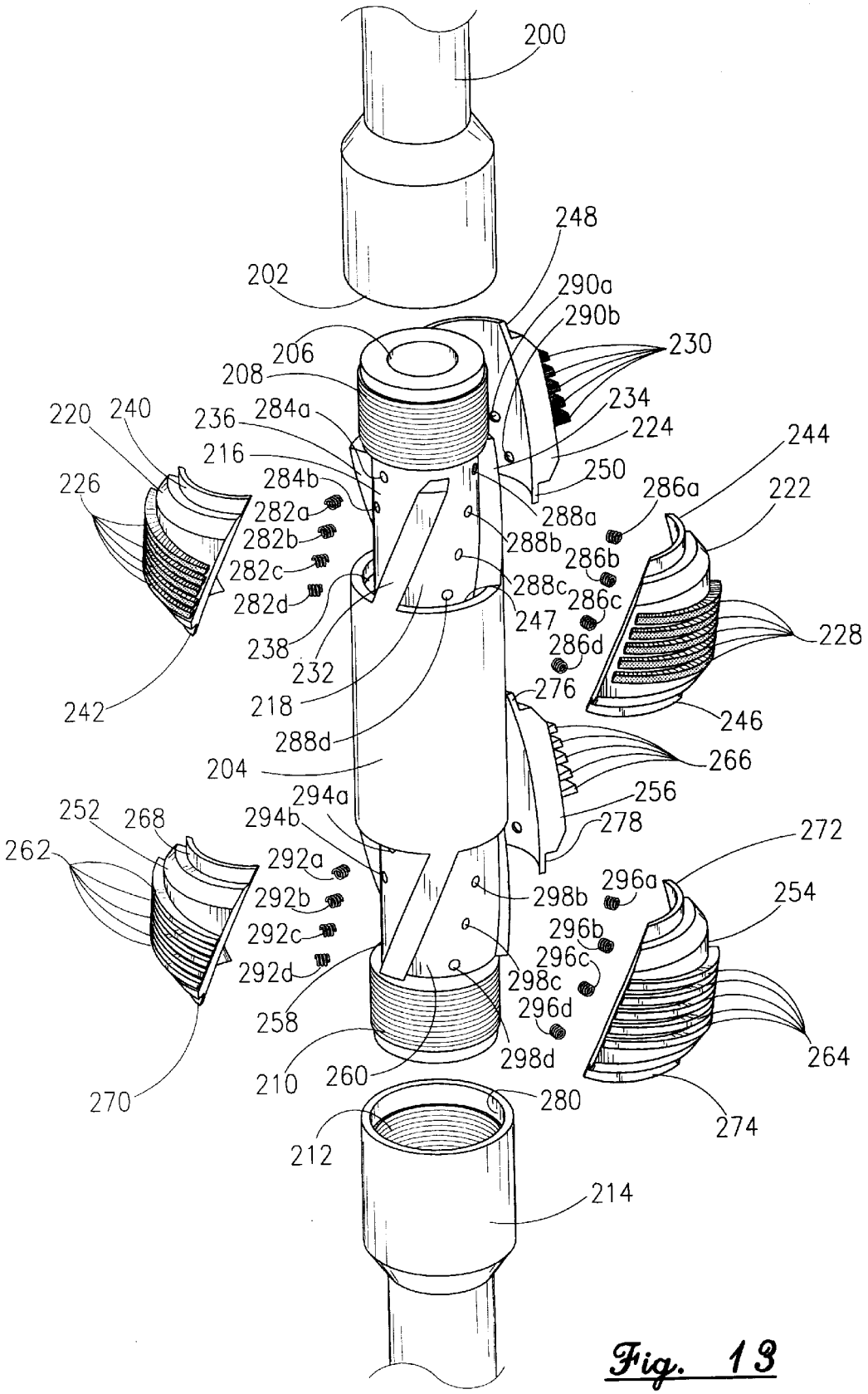
FIG. 13 is an oblique assembly view of the most preferred embodiment of this application.

Referring now to FIG. 13, the embodiment of this application will now be described. A first tubular member 200 is provided, with the tubular member 200 being concentrically disposed within a casing string. The tubular 200 is generally part of a work string such as a drill string, production string, coiled tubing, snubbing, etc. The tubular 200 has an open end 202 that contains internal thread means (not shown in this figure).

FIG. 13 also depicts the mandrel 204, with the mandrel 204 having a generally cylindrical outer surface and an internal bore section 206. The mandrel 204 has a first end that contains external thread means 208 that will mate and cooperate with the internal thread means of the tubular 200. The mandrel has a second end that contains the external thread means 210 that will threadedly attach to the internal thread means 212 of the second tubular member 214. The second tubular member 214 may be further connected to other tubular members. The open end 202 will have an annular ring, also referred to as an inner bore surface 102 shown in FIG. 9. The open end of second tubular member 214 also contains this inner bore surface (also referred to as an annular ring 280 in FIG. 13).

The mandrel 204 will contain a plurality of helical openings, for instance helical opening 216 and helical opening 218. A third helical opening is provided but not shown in the FIG. 13. The helical openings will have disposed therein the helical pads 220,222,224. The helical pads contain an arcuate body with parallelogram sides. The pads 220,222,224 will contain slotted grooves for placement of the row of brushes as was previously explained as well as seen in FIGS. 2, 3, 4, 5, 6. The pad 220 will contain the brush means 226, the pad 222 will contain the brush means 228 and the third pad 224 will contain the brush means 230. The brush means 226, 228, 230 are also constructed as previously set out and as seen in FIGS. 2, 3, 4, 5, 6.

The openings 216, 218, 220 will leave formed on the mandrel body the arms 232,234,236 thereby forming the slotted area the helical pads 220,222,224 are fitted into. The opening 216 also contains the partial radial annular groove 238, the opening 218 contains a partial radial groove 247 and the opening 220 contains a partial radial groove (not shown in this figure). The helical pad 220 contains the lip section 240 that will cooperate with the annular groove on the tubular 200. The helical pad 220 also has the lip section 242 that will cooperate with the partial radial annular groove 238. The helical pad 222 contains the lip section 244 that will cooperate with the annular groove on the tubular 200. The helical pad 222 also has the lip section 246 that will cooperate with the partial radial annular groove 247. The helical pad 224 contains the lip section 248 that will cooperate with the annular ring on the tubular 200. The helical pad 220 also has the lip section 250 that will cooperate with the partial radial annular groove on the mandrel 204. The lip sections cooperate with the openings and the annular ring of the tubular member 200 in order to form means for selectively attaching the pads to the mandrel 204, which is also referred to as dove tail means, operatively associated with the mandrel, for selectively attaching the helical pad members to the mandrel.

FIG. 13 also depicts a plurality of centralizer means which include helical pads 252,254,256. The pads 252,254,256 are inserted into the three helical openings 258, 260 (the third opening is not shown in this figure). The pads centralize as well as scrape and clean the inner diameter. The pads 252,254,256 have a series of annular ribs arranged in a slanted fashion 262,264,266, respectively. Each of the pads 252,254,256 have a lip section, namely lip section 268,270 for pad 252; lip section 272,274 for pad 254; lip section 276,278 for pad 256. A partial radial annular groove is provided within each window. Thus, lip section 268 will fit into a partial radial groove, lip section 272 will fit into a partial radial groove, and lip section 276 will fit into a partial radial annular groove.

The tubular member 214 will have an annular ring 280 (also referred to as an inner bore surface) in its open end. Thus, the lip section 270 will cooperate with annular ring 280, ip section 274 will cooperate with annular radial groove 280, and lip section 278 will cooperate with annular radial groove 280 when the thread means 212 is threadedly engaged with thread means 210 so that pads 252,254,256 are held in the three openings (258,260). These pads 252,254, 256 are to clean as well as centralize the mandrel 204. Other stabilizer means may be added to the work string if desired. For instance, a stabilizer may be added above or below the mandrel 204. An example is shown in FIG. 6.

Also included is means for biasing the pads radially outward. When the apparatus is concentrically disposed within a well bore, the biasing means will bias the pads radially outward against the casing walls at a constant force, regardless if the well bore is highly deviated or horizontal. Thus, FIG. 13 depicts the conical springs 282*a* 282*b*,282*c*, 282*d* that will have one end inserted into an aperture milled into the mandrel 204, such as the apertures 284*a*,284*b*. In the preferred embodiment, each spring will be associated with a hole; in FIG. 13, the apertures for 282*c* and 282*d* are not shown due to the curvature of the mandrel 204.

The springs 286*a*,286*b*,286*c*,286*d* will have the apertures 288*a*,288*b*,288*c*,288*d*, respectively, for biasing the pad 222 outward. The placement of the springs is along a helical path, as shown, which is also parallel to the arms e.g. 232. The helical pads of this embodiment will have a corresponding aperture for placement of the second end of the various springs. FIG. 13 depicts this feature as apertures 290*a*,290*b*. With reference to the lower helical pads of the embodiment depicted in FIG. 13, the springs 292*a*,292*b*,292*c*,292*d* are associated with apertures within the mandrel body 204 as previously stated. The apertures 294*a*,294*b* are shown. Further, there is included the springs 296*a*,296*b*,296*c*,296*d* operatively associated with the apertures within the mandrel body 204; those depicted in FIG. 13 include apertures 298*d*,298*b*,298*c*. It should also be noted that an aperture 300*a* within helical pad 256 is also depicted.

Figure 14:
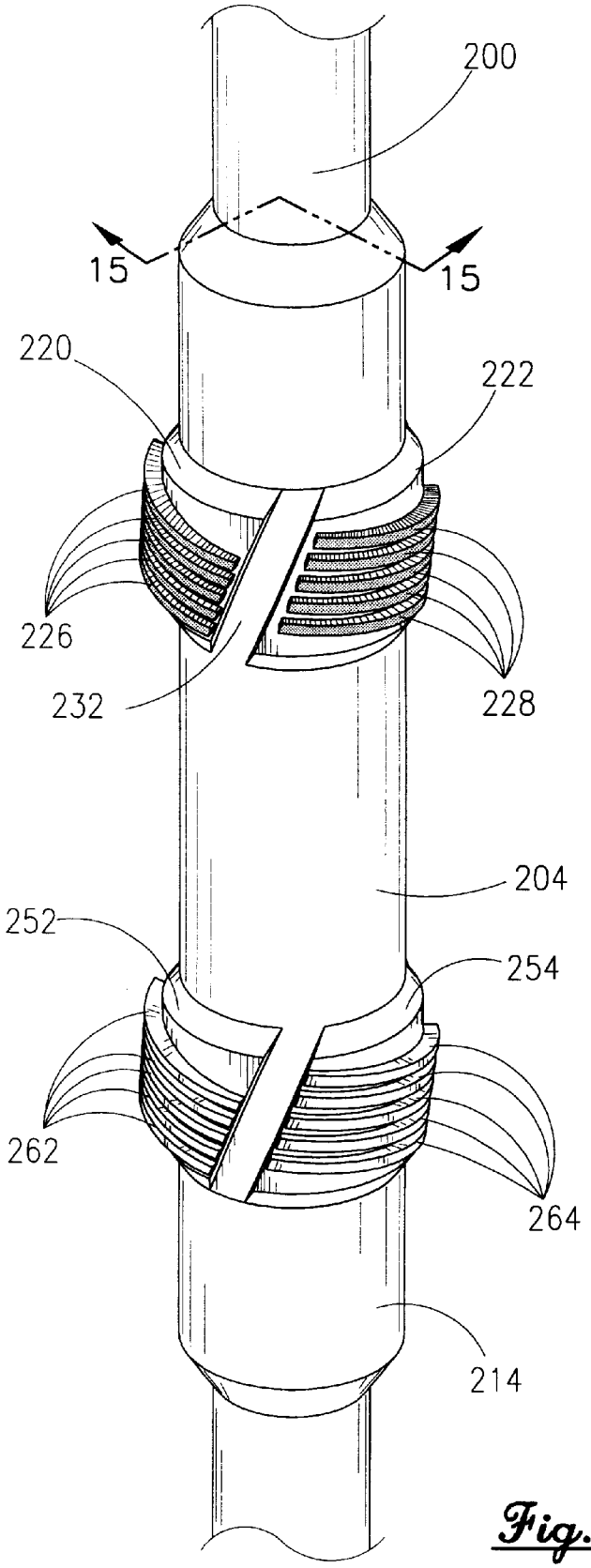
FIG. 14 is the assembled view of the most preferred embodiment of FIG. 13.

FIG. 14 depicts the assembled view of the third embodiment of FIG. 13. Thus, the pad 220 is seen with the brush means 226 and pad 222 is seen with brush means 228. The pad 252 is seen with the annular rib pattern 262 and the pad 254 is seen with the annular rib pattern 264. Note that the rib pattern is slanted in a first direction and the brush means is slanted in the same direction. However, the rib pattern may be slanted in a first direction and the brush means may be slanted in an opposite direction. Further, with the unique design herein disclosed, all of the scraper pads and brush pads are interchangeable with each other. The operator can then have all brush pads; or all scraper pads; or a combination of brush pads and scraper pads. In other words, top row can have just brush pads, or just scraper pads, or a combination of the two. The bottom row can have just brush pads, or just scraper pads, or a combination of the two.

The line 227 in FIG. 14 depicts the fact that with this novel design, the top brushes means 226*a* and the bottom brush means 228*a* effectively overlap so that a 360 degree phase coverage or more is produced by this spiral design. Without the spiral design, it was not possible in the prior art to have the top brush (located on a first pad) and the bottom brush (located on a second pad) to cover a 360 degree phase. In other words, with the prior art designs of longitudinal straight pads, a gap in coverage existed and effectively required a lower set of completely independent brush means and/or scraper pads to fill-in this gap. This design solves this problem.

Figure 15:
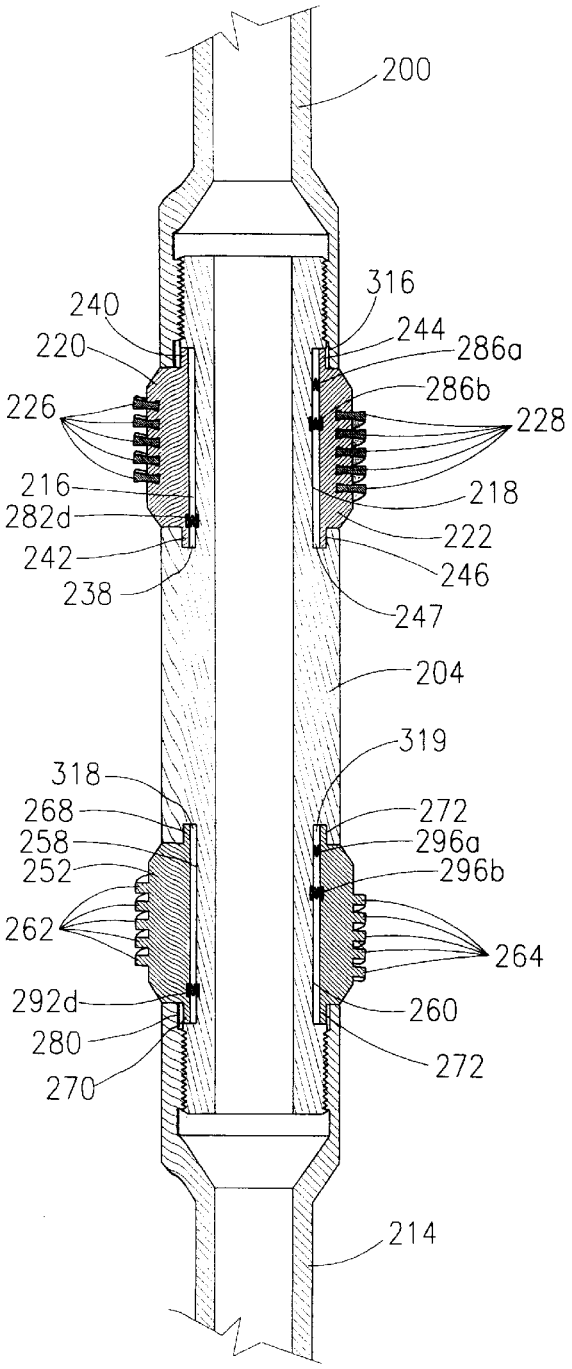
FIG. 15 is a cross-sectional view of the most preferred embodiment of FIG. 13.

Referring now to FIG. 15, a cross-sectional view of the third embodiment of this invention is illustrated. FIG. 15 is similar to FIGS. 1 and 6 in that they depict the dove tail means for selectively attaching the pads to the mandrel. More particularly, the lip 240,244 is surrounded by the annular ring surface 316 contained on the tubular 200. Further, FIG. 15 depicts the annular radial groove 238 with lips 242,246 positioned therein. Also included is the annular radial groove 318.319 that has contained therein the lips 268,272. The annular ring 280 is configured to selectively attach the lips 270,272.

Figure 16:
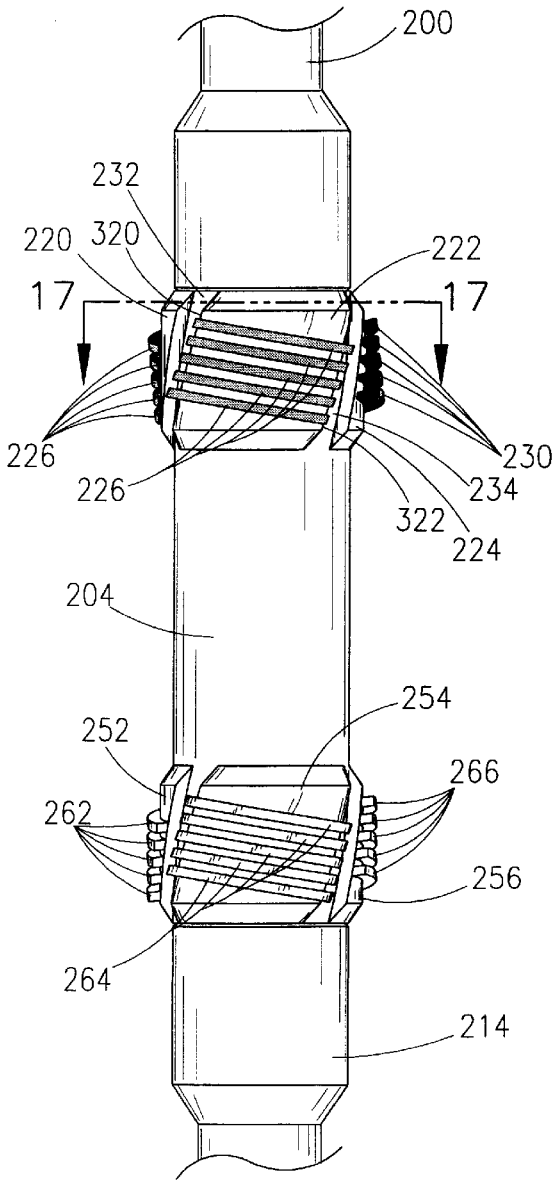
FIG. 16 is a front view of the most preferred embodiment of FIG. 13.

FIG. 16 illustrates a front view of the apparatus and in particular the helical pads. The front view of the helical pad 222 depicts generally a parallelogram having the side 320 that is slanted and parallel with the side 322, as well as parallel top and bottom sides. Note that the angle of the slant can be varied. In the most preferred embodiment, there is a 360 degree of peripheral coverage when cleaning a casing string. In other words, the brushes will effectively cover the entire 360 degree phase of the inner diameter. The lower pads with the annular ribs 264,262,266 may be slanted in the same direction and can also be designed to cover an effective 360 degree phase. It should be noted that it is also possible to have the slant of the upper brushes in an opposite slope than the lower annular ribs. As shown, there is a plurality of rows of brushes/ribs. The fluid being circulated within the annulus of the well bore can, therefore, be directed through the individual helically arranged brushes/ribs rows as well as channeled along the arms 232,234,236 during operation. Also, rotation of the work string is enhanced by the helically arranged brushes.

Figure 17:
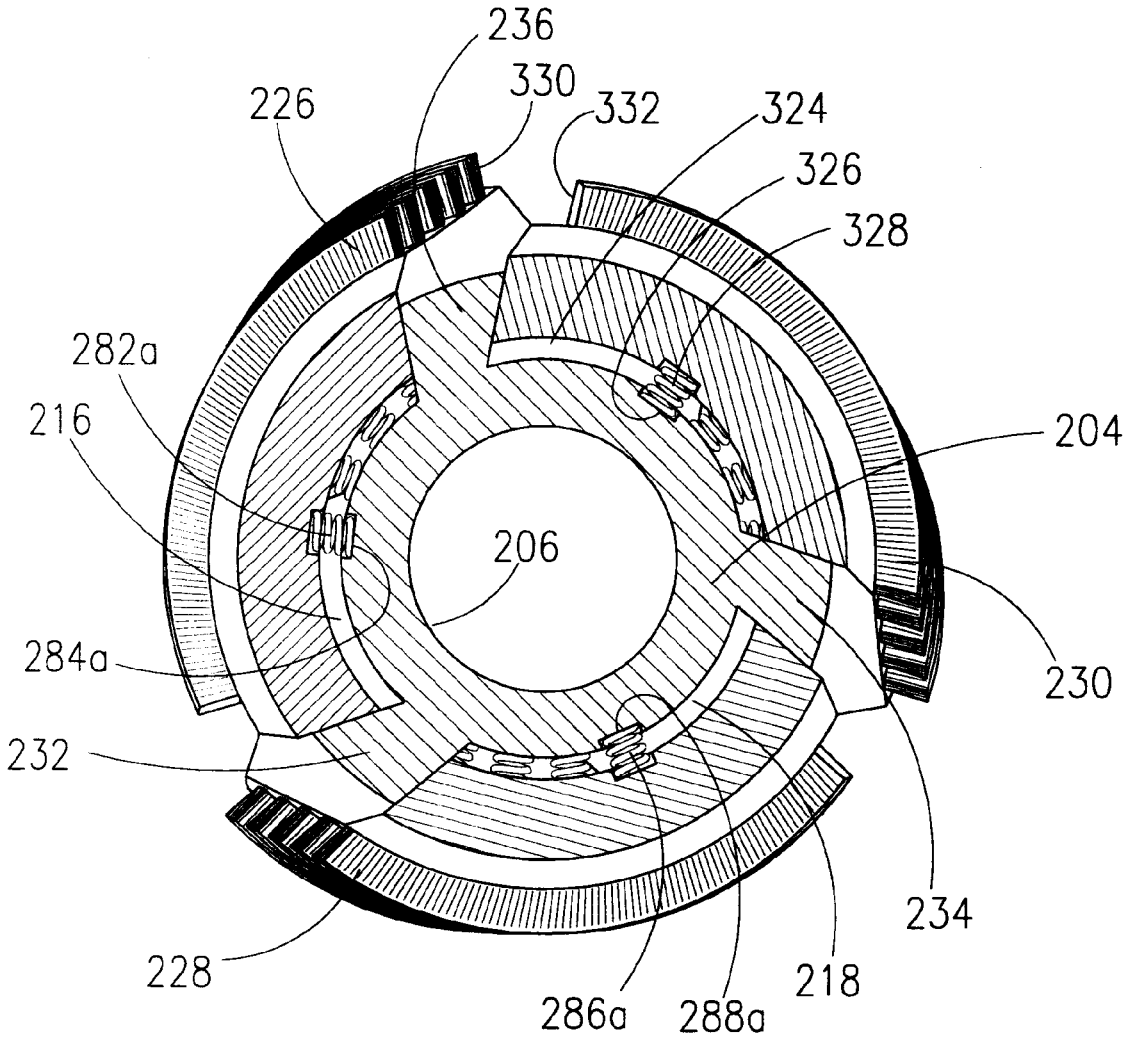
FIG. 17 is a cross-sectional view of the most preferred embodiment of FIG. 13 taken along line 17 of FIG. 16.

Referring now to FIG. 17, a cross sectional view of the apparatus taken along line 17 of FIG. 16 will now be described. The mandrel 204 with the internal bore 206 is shown, with the openings 216, 218, 324 is illustrated. The apertures 284*b*,288*b*,326 are shown with the springs 282*a*, 286*a*,328 mounted therein, respectively. The brushes 226, 228,230 are shown. The side arms of the openings are also depicted at 232,234,236. It should be noted that the brushes are inserted into a groove within the respective pads as previously described. The brush end 330 concludes so that there is a channel or gap between a complementary brush end 332. The channel, along the arms 232,234,236 provides a passage for fluid, debris and solids to channel through the tool.

It should be noted that in the embodiment of FIGS. 13, 14, 15, 16, and 17, that the lower helical pads are comprised of a series of annular extending ribs. Thus, the helical pads 252,254,256 are constructed similar to that seen in FIG. 17, except that annular extending ribs are used rather than the brush means. The annular extending ribs will be formed on the pad such as by milling as is well understood by those of ordinary skill in the art. The types of metals that the pads and ribs may be constructed of include metal, aluminum, plastic, etc.

Figure 18:
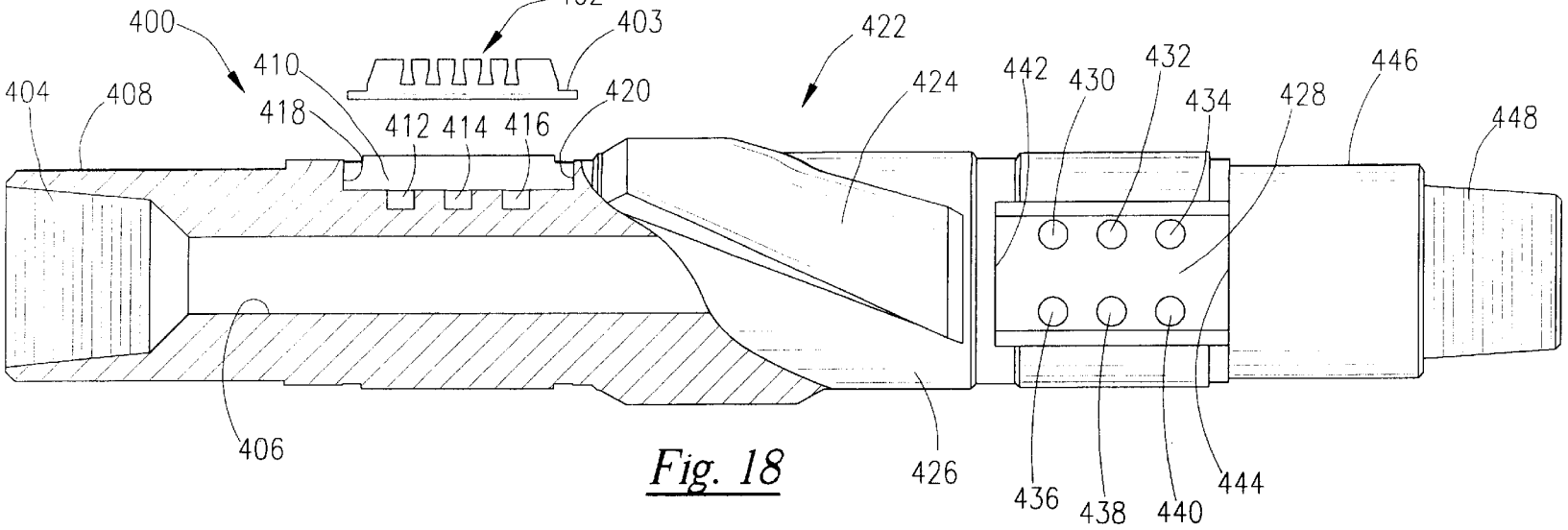
FIG. 18 is a partial cross-sectional view of the mandrel of the third embodiment of the present application.

The third embodiment of this application, which is the most preferred embodiment of this application, will now be described with reference to FIGS. 18 through 25. FIG. 18 is a partial cross-sectional view of the mandrel 400. A brush pad 402 is also depicted, with the brush pad being similar to the previously described brush pads of the first and second embodiments. Examples of the type of brush pads are seen in FIGS. 2, 3A–B, 4, 5, 7, 8, 11, 12, 13, and 14. The mandrel 400 includes a first end having an internal thread means 404 that extends to an inner bore 406. The mandrel 400 includes an outer cylindrical surface 408 that extends to the pad indentation 410, with three pad indentations being disposed about this plane level of the mandrel 400. The pad indentation 410 will further contain the cavities 412, 414. 416 for insertion of the springs (there are actually two rows, however, only one row is shown in this view). The pad indentation 410 contains the radial shoulders 418, 420.

The mandrel 400 contains a stabilizer section 422, with the stabilizer section 422 including three spiral blades. The stabilizer section 422 is integrally formed from the mandrel 400, with the blades being milled from the mandrel 400 in the preferred embodiment. The spiral blade 424 is raised from the cylindrical surface 426 and contains a curvature so that the stabilzer section 422 centralizes, stabilizers, as well as allows for better rotation of the mandrel in the down hole environment as is readily understood by those of ordinary skill in the art. The outer cylindrical surface 426 extends to the pad indentation 428, which is similar to the pad indentation 410. The cavities for the springs include 430, 432. 434. 436, 438. 440. The pad indentation has the radial shoulders 442, 444. In the preferred embodiment, there are three pad indentations disposed about this plane level of the mandrel 400. A wire brush pad (not shown) will be used similar to the pad 402 will be used. It is to be understood that any type of pad, including a metal pad with spirals may be inserted into the pad indentations. The pad indentation 428 extends to the outer cylindrical surface 446 that in turn terminates at the outer thread means 448. The pin 448 and the box 404 may be made up to a work string (such as a drill string, coiled tubing string, etc.).

Figure 19:
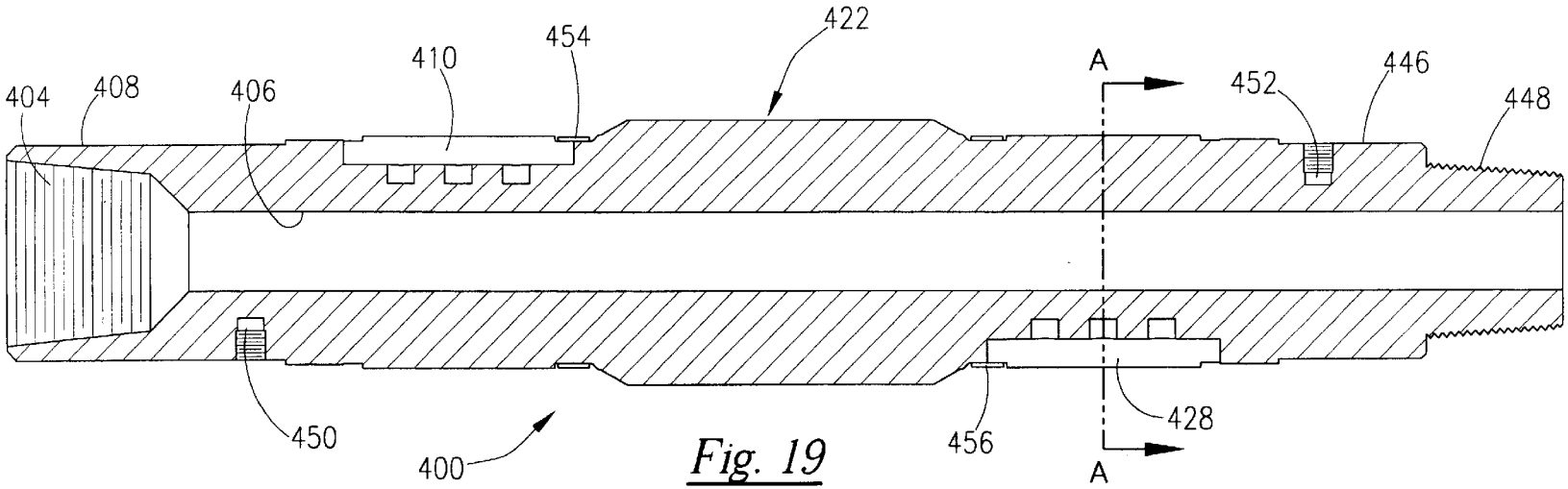
FIG. 19 is a cross-sectional view of the mandrel of the third embodiment which is depicted in FIG. 18.

Referring now to FIG. 19, a cross-sectional view of the mandrel 400 of the most preferred embodiment will now be described. The mandrel 400 has been rotated so that the apertures 450, 452 are illustrated. The apertures are cylindrical in nature. The apertures 450, 452 will contain the locking dogs, as will be described in greater detail later in the application. FIG. 19 also depicts the annular rings 454,456. The annular rings 454, 456 are disposed about the mandrel and will engage the ends of the wire brush pads such as end 403 and 562*a* as will be further discussed. The annular rings 454, 456 may be integrally formed on the mandrel 400 or may be attached using conventional means such as welding.

Figure 20:
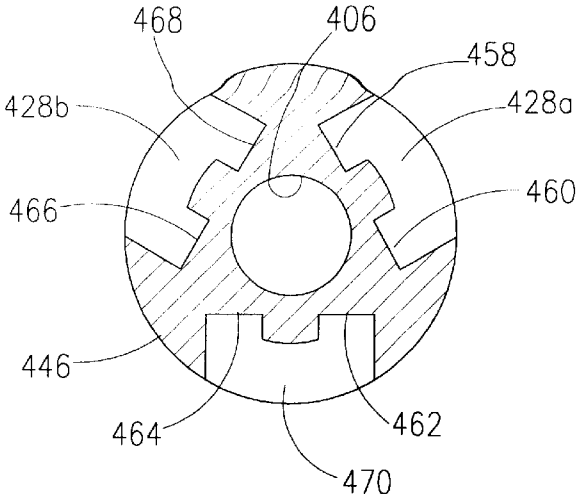
FIG. 20 is a cross-sectional view taken from the line A—A of FIG. 19.

In FIG. 20, a cross-sectional view taken from the line A—A of FIG. 19 will now be discussed. The mandrel 400 contains three pad indentations, namely 428*a*, 428*b*, 470 in the outer cylindrical surface 446. The individual indentations contain the previously mentioned cavities, with each indentation containing two rows of cavities. As seen in FIG. 20, the cavities 458, 460. 462. 464, 466. 468 are provided for placement of the springs. FIG. 20 also depicts the feature of having three pads disposed about the mandrel in the same plane level.

Figure 21:
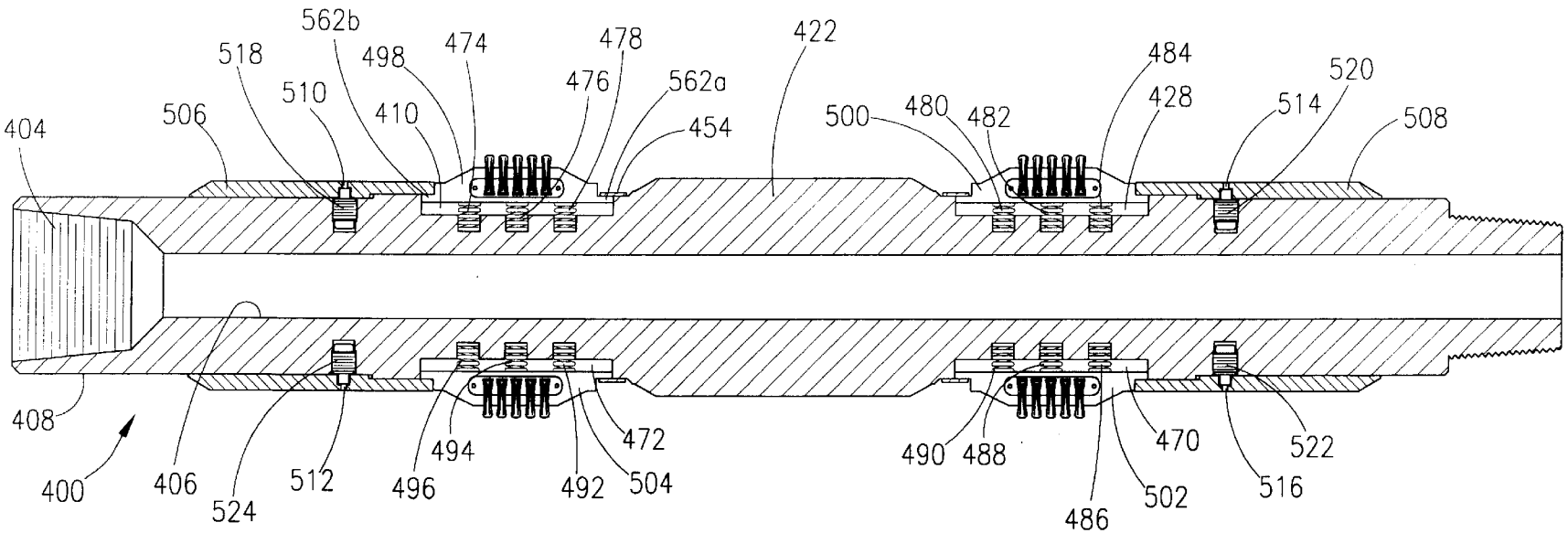
FIG. 21 is a cross-sectional view of the third embodiment of the novel apparatus.

Referring now to FIG. 21, a cross-sectional view of the third embodiment depicted in FIG. 18 will now be described. The FIG. 21 contains the indentations 410, 428, 470, 472. The springs 474, 476 478, 480, 482, 484. 486. 488, 490, 492. 494, 496. The wire brush pads seen in FIG. 21 include 498. 500, 502, 504. As noted earlier, the springs and wire brush pads are similar to those already described.

FIG. 21 also depicts sleeve 506 and sleeve 508. The sleeves are generally cylindrical in formation and will be described in greater detail in the discussion of FIGS. 23, 24. The sleeve 506 contains three openings disposed about the periphery, with the openings 510, 512 seen in FIG. 21; and the sleeve 508 contains three openings, with the openings 514. 516 seen in FIG. 21. Additionally, FIG. 21 depicts the locking dogs 518. 520. 522, 524 disposed within a receiving aperture, the aperature contained within the body of the mandrel 400. Therefore, the sleeves 506, 508 are disposed over the mandrel, and the locking dogs 518, 520, 522, 524 are configured to lock the sleeves in place.

Figure 22:
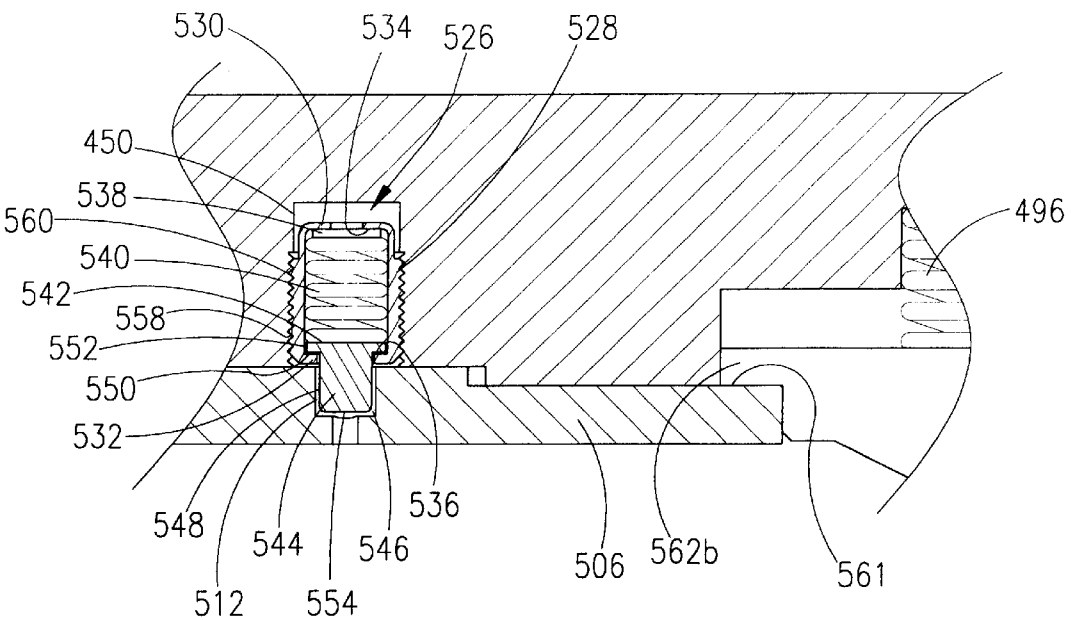
FIG. 22 is an enlargement of the locking dog arrangement seen in FIG. 21.

FIG. 22 is an enlargement of the locking dog arrangement seen in FIG. 21. Thus, the locking dog 526 generally consist of an outer member having a generally cylindrical body 528, with the cylindrical body 528 having a first semi-closed end 530 and a second semi-closed end 532 thereby forming a chamber. The end 530 will have a radial shoulder 534 and the end 532 will have a radial shoulder 536. Within the chamber is a disc 538 (such as a washer) which is placed adjacent the end 530 and will abut the coil spring 540, which in turn will engage the underside 542 of the stem 544. The spring 540 urges the stem 544 through the opening 546 that is contained in the end 532. The stem 544 generally contains a first outer cylindrical surface 548 that extends to the radial shoulder 550 which in turn stretches to the second outer cylindrical 552. The stem 544 has a first face 554 and a second face 556. The outer portion of the cylindrical body 528 contains external thread means 558 that engage the internal thread means 560 contained opening 450 within the body of the mandrel 400.

The cylindrical surface 548 of the stem 544 is urged into the opening 512 contained within the sleeve 506. Thus, the sleeve 506 is locked into place by the engagement of the surface 548 into the sleeve's opening 512. In the most preferred embodiment, three locking dogs are employed about the mandrel 400, with each locking dog engaging a cooperating opening in the sleeve in order to lock the sleeve in place.

The sleeve 506 has the inner surface 561 that will act to engage an end of the brush pad. Thus, the brush pad will have one end 562*a* (see FIG. 21) engaging the annular ring 454 and the second end 562*b* (see FIG. 22) engaging sleeve's inner surface 561 so that the brush pad is held in place. The springs will urge the brush pad outward as previously discussed.

Figure 23:
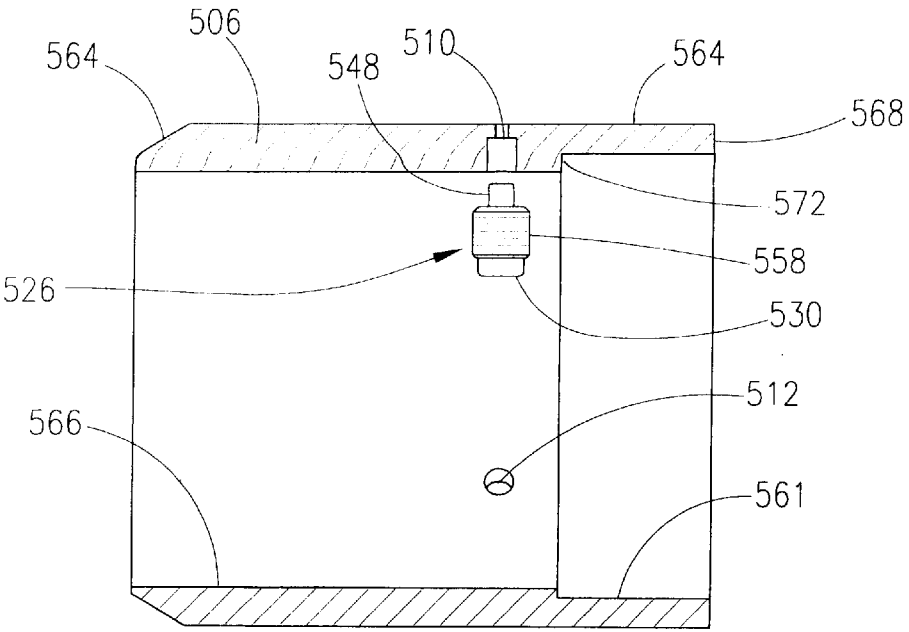
FIG. 23 is a side cross-sectional view of the sleeve and a locking dog of the third embodiment.

FIG. 23 depicts a side cross-sectional view of the sleeve 506 and a typical locking dog 526 of the third embodiment. As illustrated, the sleeve 506 contains an outer cylindrical surface 562 that extends to an angled surface 564 which in turn extends to the inner bore 566. As seen in the FIG. 23, the angled surface 564 makes an angle of approximately 20 degrees relative to the inner bore in the most preferred embodiment. At the opposite side, the cylindrical surface 562 extends to the end 568 and then extends to the inner diameter surface 561 and then to radial shoulder 572. The end of the brush member will engage the inner diameter surface 561 and shoulder 572 to lock the brush pad in place. Additionally, this FIG. 23 depicts another opening 512 for another locking dog (not shown in this illustration).

Figure 24:
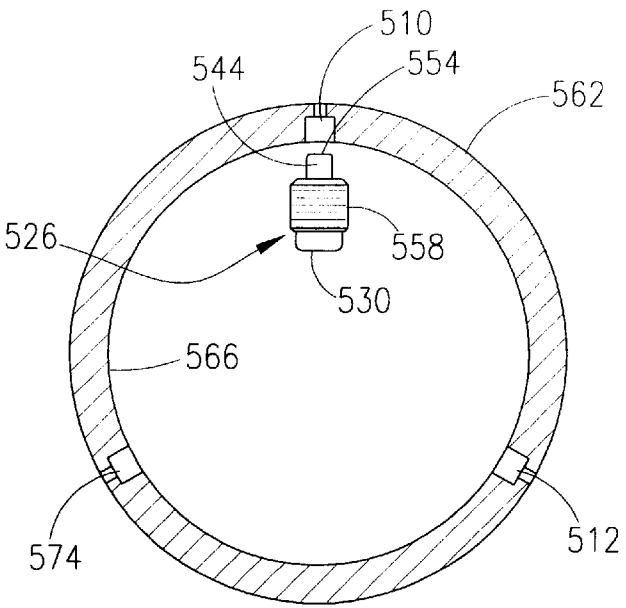
FIG. 24 is a top cross-sectional view of the sleeve and a locking dog seen in FIG. 23.

Referring now to FIG. 24, a top cross-sectional view of the sleeve 506 and a typical locking dog 526 seen in FIG. 23. This view depicts the opening 510, opening 512 and the opening 574 that included in a typical sleeve design.

Figure 25:
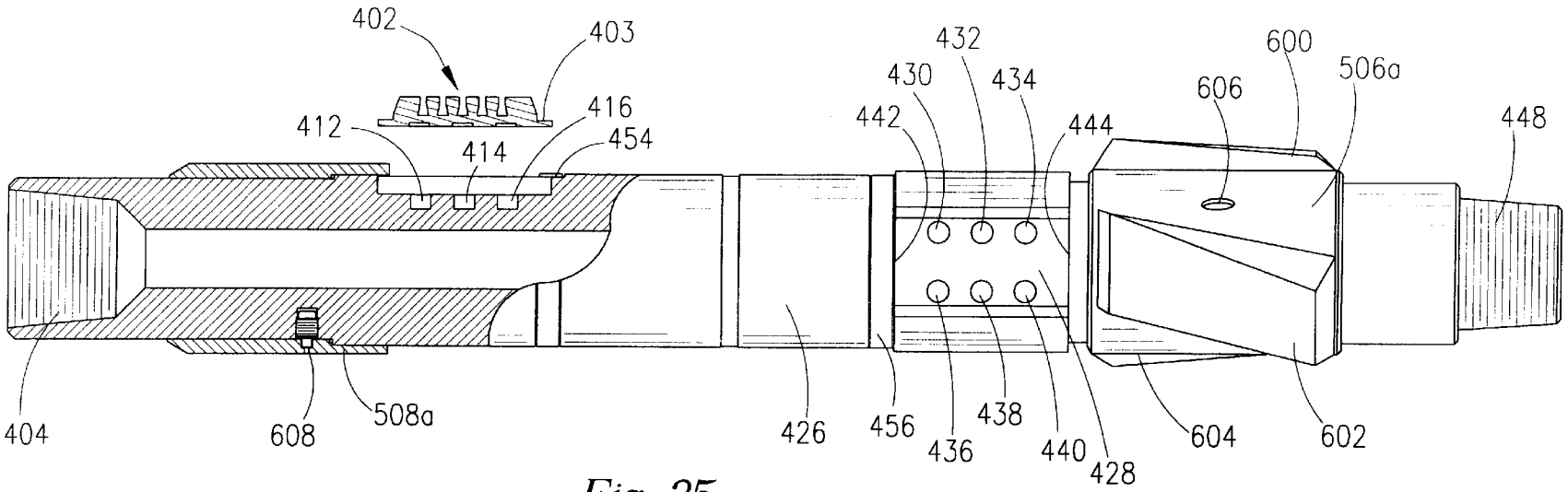
FIG. 25 is a partial cross-sectional view of the mandrel of the fourth embodiment of the present application.

FIG. 25 is a partial cross-sectional view of the mandrel of the fourth embodiment of the present application. It should be noted that like numbers appearing in the various figures refer to like components. The fourth embodiment is essentially identical to the third embodiment except that the sleeves also perform the function of a stabilizer and centralizer. As seen in FIG. 25, mandrel 400 is similar to the embodiment depicted in FIG. 18. The pad indentation 410 and the pad indentation 428 are included, along with the cavities 430, 4342, 434, 436, 438, 440. The brush pad 402 is also shown.

The sleeves 506*a* and 508*a* are included, with the sleeves 506*a*, 508*a* also including a plurality of spiral blades such as 600, 602, 604. The outer diameter of the spiral blades have an outer diameter greater than the outer diameter surface of the sleeves which allows for blades to centralize and stabilize the mandrel within a well bore as is readily understood by those of ordinary skill in the art. It should be noted that centralizer seen in FIG. 18 has been removed, with the center of the mandrel being a generally cylindrical surface 426 along with a stencil groove for writing or handling purposes, if desired.

The sleeves 506*a*, 508*a* contain apertures, with the aperture 606 shown for the sleeve 506*a* and the aperture 608 shown for the sleeve 506*b*. As noted in the cross-sectional portion, a cavity 610 is included for the inclusion of the locking dogs, as previously described. Thus, the sleeves 506*a*, 508*b* serve the dual role of allowing a removable sleeve for engaging with the brush pads as well as serving as a centralizer and stabilizer.

In operation of this third and fourth embodiment, when the operator desires to replace the brush pads, the operator can apply pressure to the stem 544 of the locking dog 526. Once the end 554 clears the inner sleeve surface 566 (on all locking dogs employed), the sleeve can be removed since there is no longer any stem holding the sleeves in place. Next, the pad can be changed or repaired. Once the operator determines that the sleeves can be positioned about the mandrels again, the stems will be depressed using conventional means, and the sleeve is slipped over the mandrel. Once the openings of the sleeve pass over the stems, the stems will be free to expand via the spring into the openings within the sleeve. Once the stems expand into the openings in the sleeve, the sleeve is locked into place.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

I claim:

1. A down hole assembly comprising:

a mandrel having a first opening, said mandrel having a first aperture therein, and wherein said first opening has a first lip;

a first wire brush member inserted into said first opening;

a first spring positioned between said first wire brush member and said first opening, said first spring biasing said first wire brush outward;

a first sleeve disposed about said mandrel, said first sleeve engaging first wire brush member;

a first locking dog disposed in said aperture, said first locking dog having a first end engaging said first sleeve.

2. The assembly of claim 1 wherein said mandrel contains a second opening and a second aperture, and wherein the assembly further comprises:

a second wire brush member inserted into said second opening;

a second spring positioned between said second wire brush member and said second opening, said second spring biasing said second wire brush outward;

a second sleeve disposed about said mandrel, said second sleeve engaging said second wire brush member;

a second locking dog disposed in said second aperture, said second locking dog having a first end engaging said second sleeve.

3. The assembly of claim 2 wherein said first and second locking dog comprises:

a cylindrical member having a bottom portion and a top portion, wherein said cylindrical member contains an external threads engaging an internal thread on said first and second aperture of said mandrel, and wherein said top portion and said bottom portion form a chamber;

a spring contained within said chamber;

a stem having a shoulder thereon, and wherein said stem engages a depression in said first sleeve and said second sleeve.

4. The assembly of claim 3 wherein said first wire brush member and said second wire brush member comprises:

a wire bundle having a first end and a second end;

a brace disposed about said second end of said wire bundle;

and wherein said brace is disposed within a groove in said first wire brush member.

5. The assembly of claim 4 wherein said brace comprises:

an open end and a closed end of said brace, with the closed end having disposed therein said second end of said wire bundle, and wherein said open end and said closed end of said brace cooperate to form a triangular shaped profile.

6. The assembly of claim 5 wherein said groove has an angular shaped profile adapted to slidably receive said triangular shaped profile of said brace.

7. The assembly of claim 6 wherein said first opening and said second opening of said mandrel are helically shaped, and wherein said first wire brush member and said second wire brush member are helically arranged.

8. The assembly of claim 7 wherein said first wire brush member and said second wire brush ember are arcuate, and wherein said first wire brush member is disposed about the periphery of said mandrel to cover a first phase and wherein said second wire brush member is disposed about the periphery of said mandrel to cover a second phase.

9. A method of cleaning a casing string, said casing string having an internal portion, the method comprising:

lowering a work string within said internal portion of said casing string;

providing a cleaning apparatus attached to said work string, said apparatus comprising:

a mandrel having a first opening and second opening, said mandrel having a first aperture and a second aperture therein, and wherein said first opening has a first lip; a first wire brush pad inserted into said first opening; a first spring positioned between said first wire brush pad and said first opening, said first spring biasing said first wire brush pad outward; a first sleeve disposed about said mandrel, said first sleeve engaging said first wire brush pad; a first locking dog disposed in said first aperture, said first locking dog having a first end engaging said first sleeve; a second wire brush pad inserted into said second opening; a second spring positioned between said second wire brush pad and said second opening, said second spring biasing said second wire brush pad outward; a second sleeve disposed about said mandrel, said second sleeve engaging said second wire brush pad; and, a second locking dog disposed in said second aperture, said second locking dog having a first end engaging said second sleeve; and wherein the method further includes;

urging said firstwire brush pad and said second wire brush pad against the internal portion of said casing string with said first spring and said second spring; and, cleaning the internal portion of said casing string.

10. The method of claim 9 further comprising:

rotating the work string;

lowering the work string;

circulating a fluid through the internal portion of the work string and returning the fluid in an annulus area;

channeling the fluid through said first wire brush pad and said second wire brush pad.

11. The method of claim 10 wherein said well casing has a highly deviated section so that a low side of the well casing and a high side is created, and the apparatus further comprises a centralizer operatively associated with said mandrel, with the first wire brush pad covering a first phase and the second wire brush pad covering a second phase, and wherein the method further comprises:

lifting the apparatus from the low side of the inner diameter of the well casing with said centralizer;

urging said first wire brush pad against the low side of the inner diameter of the well casing with said first spring at a constant force;

urging said second wire brush pad against the high side of the inner diameter of the well casing with said second spring at the constant force.

12. An apparatus for cleaning an inner diameter of a casing string, the apparatus comprising:

a mandrel having a first end and a second end, said first end of said mandrel being configured to be connected to an opened end of a first tubular member and said second end of said mandrel being configured to be connected to an opened end of a second tubular member, and wherein the mandrel contains a first indentation, and wherein said first indentation has a first lip and a first aperture;

a first wire brush member inserted into said first indentation;

a first spring positioned between said first wire brush member and said first indentation, said first spring biasing said first wire brush member outward;

a first sleeve disposed about said mandrel, said first sleeve engaging said first wire brush member, a first locking dog disposed in said first aperture, said first locking dog having a first end engaging said first sleeve.

13. The apparatus of claim 12 wherein said first locking dog comprises:

a cylindrical member having a bottom portion and a top portion, said cylindrical member having an external thread means engaging an internal thread means on said first aperture of said mandrel, and wherein said bottom portion and said top portion forms a chamber;

a biasing means, contained within said chamber, for urging a stem in an outward direction, and wherein said stem engages a depression in said first sleeve.

14. The apparatus of claim 13 wherein said first wire brush member comprises:

a wire bundle having a first end and a second end;

a brace disposed about said second end of said wire bundle;

and wherein said brace is disposed within a groove in said first wire brush member.

15. The apparatus of claim 14 wherein said brace comprises:

an open end and a closed end, with the closed end of said brace having disposed therein said second end of said wire bundle, and wherein said open end and said closed end of said brace cooperate to form a triangular shaped profile.

16. The apparatus of claim 15 wherein said groove has an angular shaped profile adapted to slidably receive said triangular shaped profile of said brace.

17. The apparatus of claim 16 wherein said first indentation is helically shaped, and wherein said first wire brush member is helically arranged.

18. The apparatus of claim 17 wherein said mandrel contains a second indentation, and wherein the apparatus further comprises:

a second wire brush member inserted into said second indentation;

a second spring positioned between said second wire brush member and said second indentation, said second spring biasing said second wire brush member outward;

a second sleeve disposed about said mandrel, said second sleeve engaging second wire brush member;

a second locking dog disposed in said first aperture, said second locking dog having a first end engaging said second sleeve.

19. The apparatus of claim 18 wherein said first wire brush member and said second wire brush member are arcuate, and wherein said first wire brush member is disposed about the periphery of said mandrel to cover a first phase and wherein said second wire brush member is disposed about the periphery of said mandrel to cover a complimentary second phase.

20. The apparatus of claim 13 wherein said first sleeve has an outer diameter that contains a series of spiral blades for centralizing said mandrel in the inner diameter of the casing string.

21. The apparatus of claim 13 further comprising:

a centralizer formed on said mandrel for centralizing said mandrel in the inner diameter of the casing string.

* * * * *